US008276413B2

(12) United States Patent
Talpe

(10) Patent No.: US 8,276,413 B2
(45) Date of Patent: Oct. 2, 2012

(54) PUSHBUTTON COMBINATION LOCK

(76) Inventor: Joseph Talpe, Avelgem-Kerkhove (BE)

( * ) Notice: Subject to any disclaimer, the term of this patent is extended or adjusted under 35 U.S.C. 154(b) by 985 days.

(21) Appl. No.: 12/162,401

(22) PCT Filed: Dec. 13, 2006

(86) PCT No.: PCT/EP2006/069691

§ 371 (c)(1),
(2), (4) Date: Jul. 28, 2008

(87) PCT Pub. No.: WO2007/087932

PCT Pub. Date: Aug. 9, 2007

(65) Prior Publication Data

US 2009/0013737 A1 Jan. 15, 2009

(30) Foreign Application Priority Data

Jan. 31, 2006 (EP) ..... 06101116

(51) Int. Cl.
*E05B 37/16* (2006.01)

(52) U.S. Cl. ..... 70/214; 70/298; 70/299

(58) Field of Classification Search ..... 70/214, 70/297, 298, 299, 287–289, 300, 333 R
See application file for complete search history.

(56) References Cited

U.S. PATENT DOCUMENTS

| | | | | |
|---|---|---|---|---|
| 1,500,657 | A | 7/1924 | Stolberg | |
| 2,109,264 | A * | 2/1938 | Elbaum | 70/298 |
| 2,997,872 | A * | 8/1961 | Brooks | 70/298 |
| 3,009,346 | A * | 11/1961 | Check | 70/214 |
| 3,099,150 | A | 7/1963 | Check | |
| 3,187,528 | A | 6/1965 | Check | |
| 4,748,833 | A * | 6/1988 | Nagasawa | 70/214 |
| 6,272,889 | B1 | 8/2001 | Burleigh | |
| 6,334,346 | B1 * | 1/2002 | Wang | 70/214 |
| 2003/0126896 | A1 * | 7/2003 | Mori | 70/214 |
| 2006/0107712 | A1 * | 5/2006 | Wang | 70/214 |
| 2007/0144226 | A1 * | 6/2007 | Miao | 70/214 |
| 2008/0115546 | A1 * | 5/2008 | Hu | 70/214 |

FOREIGN PATENT DOCUMENTS

| | | |
|---|---|---|
| DE | 512619 | 11/1930 |
| EP | 1118739 A1 | 7/2001 |
| FR | 799690 | 6/1936 |
| GB | 918696 | 2/1963 |
| GB | 2176233 A | 12/1986 |
| GB | 2401645 | 11/2004 |

* cited by examiner

*Primary Examiner* — Christopher Boswell
(74) *Attorney, Agent, or Firm* — Sughrue Mion, PLLC

(57) ABSTRACT

The lock comprises a lock bolt, in particular a latch bolt (17), the actuating mechanism of which can be locked by means of a locking mechanism which comprises one series of pushbuttons (25) on each side of the lock. The pushbuttons (25) act on code and blocking tumbler members so that when the correct number combination is put in, one of the two check slides (39) is released. A selector (59) couples the two check slides (39) to the lock bolt actuating mechanism so that, when one of the two check slides is released, the lock bolt (17) can be moved to its unlocking position. The lock can thus be unlocked from either side of the lock and, due to the two locking mechanisms, a different number combination can be set for the two sides. The tumbler members each preferably comprise a first tumbler element, consisting of a base element and a code element screwed onto the base element, and a second tumbler arranged in the check slide and biased by means of a spring against the code element. With such tumbler members, it is easier to modify the number combination.

22 Claims, 25 Drawing Sheets

PUSHBUTTON COMBINATION LOCK

The present invention relates to a pushbutton combination lock comprising a frame, a lock bolt mechanism comprising a lock bolt movably mounted on the frame between a locking and an unlocking position and a lock bolt actuating mechanism arranged to move the lock bolt between the locking and unlocking positions and operable from a first and a second side of the lock, and a locking mechanism for locking the lock bolt mechanism to prevent the lock bolt from being moved by the lock bolt actuating mechanism to the unlocking position, which locking mechanism comprises a first series of pushbuttons on the first side of the lock and a second series of pushbuttons on the second side of the lock and a first series of tumbler members movable between normal and depressed stable positions by means of respective pushbuttons of said first pushbutton series.

Such a pushbutton combination lock is disclosed in GB-A-2 176 233. In this known lock the proximal end of the lock bolt is in the form of a check slide which can be blocked or released by the tumbler members. The tumbler members, which are provided with grooves, can be positioned in such a manner that the grooves therein can be aligned for receiving the check slide end of the lock bolt to permit unlocking of the lock. Each of the tumbler elements is provided with an additional groove, opposite the first grooves, so that by repositioning the tumbler members another number combination can be set.

The lock disclosed in GB-A-2 176 233 comprises a series of pushbuttons on both sides of the lock so that from both sides the number combination can be entered to unlock the lock. An advantage of such a lock is therefore that from neither side of the door, the door can be freely opened so that the door or gate does not have to be completely closed to prevent access to the door handle on the other side of the door or gate. This is especially the case for outdoor doors or gates, such as garden gates or gates in fences. Although the lock comprises a series of pushbuttons on both sides, it comprises only one series of tumbler members and only one check slide. The pushbuttons on both sides of the lock act therefore onto the same tumbler members so that a same number combination has to be used on both sides of the lock. It is thus not possible to set one complex number combination on the outer side and a less complex combination on the inner side.

Another drawback is that the tumbler members have to be reset manually each time after having unlocked the lock. Immediate resetting is especially required since the pushbuttons are formed by push members, the position of which indicates the position of the tumbler members so that the combination required to unlock the lock is readily visible if the tumbler members are not reset. A further drawback of the lock disclosed in GB-A-2 176 233 is that the number combination of the lock is quite difficult to change and requires quite a lot of skill. The lock has indeed to be opened, the tumbler members have to be removed and have to be repositioned and the lock has again to be closed. Repositioning of the tumbler elements and closing of the lock is not so easy since different elements, such as the spring detents and the push members engage the tumbler members and have to be brought all at once in engagement with the tumbler members. A final drawback of the lock disclosed in GB-A-2 176 233 is that it is not very tamper-proof. When exerting a force onto the unlocking button so that the check slide presses against the tumbler members, an intruder can get a tactile indication of which pushbuttons have to be depressed. The check slide will indeed penetrate somewhat in the groove of the tumbler members which are in the right position so that some additional resistance will be felt when pushing onto the corresponding pushbuttons.

An object of the present invention is now first of all to provide a lock with a series of pushbuttons on both sides of the lock for which a different combination can be set on both sides of the lock. The combination may in particular be a much easier combination on one side, in particular to enable persons leaving a certain area, such as a domestic garden or a factory site, to unlock the lock more easily and quickly than persons who want to enter that area.

To this end the lock according to the invention is characterised in that the locking mechanism further comprises a first check slide movably mounted on the frame and co-operating with the first series of tumbler members to be blocked or released thereby; a second series of tumbler members movable between normal and depressed stable positions by means of respective pushbuttons of said second pushbutton series; a second check slide movably mounted on the frame and co-operating with the second series of tumbler members to be blocked or released thereby; and a selector which is movably mounted on the frame and which is blocked or released by the first and second check slides, the selector coupling the first and/or the second check slides to the lock bolt mechanism so that, at least when the first and the second check slides are blocked, the selector is blocked and is locking the lock bolt mechanism, and the selector being arranged to be released by either the first or the second check slide so that the lock bolt mechanism can be unlocked by releasing the first or respectively the second check slide.

Due to the fact that the lock comprises not only two series of pushbuttons, but also two series of tumbler members, two check slides and a selector coupling the two check slides to the lock bolt mechanism and enabling to unlock this lock bolt mechanism either by means of the first series of pushbuttons or by means of the pushbuttons, the lock cannot only be unlocked from both sides of the lock but it is possible to set different number combinations on both sides of the lock.

For enabling the selector to be released by either the first or the second check slide, it is possible to provide a switching mechanism which is manually operable from both sides of the lock and which enables to switch the selector between a first position wherein it is coupled to the first check slide and a second position wherein it is coupled to the second check slide. A person who wants to unlock the lock from the first side of the lock therefore has to switch the selector by means of the switching mechanism, including for example an additional button on the first side of the lock, to the first check slide whilst a person who wants to unlock the lock from the second side of the lock has to switch the selector by means of the switching mechanism, including for example an additional button on the second side of the lock, to the second check slide.

In a preferred embodiment of the lock according to the invention, such a manual intervention is however not required to select either the first check slide if one is on the first side of the lock or the second check slide if one is on the second side of the lock. This preferred embodiment is characterised in that the selector comprises a switch element which engages both the first and the second check slides to lock the lock bolt mechanism when the first and second check slides are blocked, which switches to the first check slide so that the selector is released and the lock bolt mechanism unlocked thereby when the first check slide is released whilst the second check slide remains blocked and which switches to the second check slide so that the selector is released and the lock bolt mechanism unlocked thereby when the second check slide is released and the first check slide remains blocked.

In this preferred embodiment, the switch element of the selector switches automatically to or selects in other words automatically the check slide which is released so that the lock can be unlocked from either one side of the lock, whilst the check slide releasable from the other side of the lock remains blocked.

In a further preferred embodiment, the lock bolt is a latch bolt which is biased by means of a latch bolt spring out of the frame of the lock and the selector couples the first and/or the second check slides to the lock bolt actuating mechanism so that the latch bolt can be pushed in against the spring bias even when the first and the second check slides are both blocked. Preferably, the lock further comprises a dead bolt and a key operated dead bolt actuating mechanism.

Since the lock bolt is a latch bolt, it is possible to provide a reset mechanism which immediately resets the locking mechanism after having unlocked the lock. The lock bolt has indeed not to be withdrawn by means of the handles to enable to close the door again. The door is thus always automatically locked again when a reset mechanism is provided.

In addition to the latch bolt, the lock preferably comprises a dead bolt and a key operated dead bolt actuating mechanism. In this way the lock can be locked more reliably, for example at night or when everybody has left, by means of the key operated mechanism (the combination lock provides indeed only a limited number of possible combinations, namely only 1024 combinations for 10 pushbuttons). At daytime, or when several persons have to be able to unlock the lock, the dead bolt can be unlocked so that all the persons who know the number combination can unlock the lock.

As described hereabove, a further drawback of the lock disclosed in GB-A-2 176 233 is that the number combination of the lock is quite difficult to change and requires quite a lot of skill. Another object of the present invention is therefore to provide a pushbutton combination lock which comprises a series of pushbuttons, a series of tumbler members movable by means of the pushbuttons and a check slide which can be blocked or released by the tumbler members, and which enables to modify the tumbler elements in an easier way to change the number combination.

This is achieved in the pushbutton combination lock as defined in claim 16 which may comprise only one series of pushbuttons or two series of pushbuttons, one on each side of the lock. In this lock, each of the tumbler members consists of a first tumbler element which is movable in a hole in the frame and of a second tumbler element which is movable in an opposite hole in the check slide and is biased by means of a spring against the first tumbler element. The first tumbler element is further composed of a base body, which is movably mounted in the hole of the first tumbler element in the frame, and a code body which is removably fixed to the base body to extend through a through hole of the base body to engage the second tumbler element. In such a lock, the tumbler members do not have to be removed and repositioned as a whole in the lock to change the number combination but only the code bodies, which have different lengths, have to be removed and repositioned in the base bodies. In a preferred embodiment, the code bodies can more particularly be screwed simply into and out of the base bodies.

A final drawback of the lock disclosed in GB-A-2 176 233 was that it is not very tamper-proof due to the fact that when exerting a force onto the unlocking button so that the check slide presses against the tumbler members, an intruder can get a tactile indication of which pushbuttons have to be depressed to unlock the lock. A further object of the present invention is thus to enhance the security of the pushbutton combination lock.

Such an enhanced security is achieved in the pushbutton combination locks as defined in claims 5 and 6, which comprise two series of pushbuttons, and in the push button combination locks as defined in claims 21 and 22, which have to comprise only one series of pushbuttons.

The locks defined in these claims comprise a security slide which is interposed between the pushbuttons and the tumbler members and which is movable between two positions. In its normal or rest position, the security slide allows the tumbler members to be moved by the pushbuttons. When actuating the lock bolt mechanism, the security slide is however moved to its second position wherein it prevents the tumbler members from being moved by the respective pushbuttons. Consequently, when trying to pick the pushbutton combination, an intruder cannot push in the pushbuttons while forcing at the same time the check slide against the tumbler members to get a tactile indication of which tumbler members have to be depressed.

U.S. Pat. No. 6,272,889 also discloses a system for enhancing the security of a pushbutton combination lock. In this known system each pushbutton has an attached blocking member which projects into a notch in the check slide when depressing the pushbutton so that it limits the movements of the check slide. In this way an attacker would not be able to gain any tactile feedback by trying to operate the lock while pressing on different buttons. However, it is still possible to get a tactile indication of which pushbuttons have to be depressed by first operating the lock so that the check slide is forced against the tumbler members and then pressing the different buttons.

Other particularities and advantages of the invention will become apparent from the following description of some particular embodiments of the pushbutton combination lock according to the present invention. The reference numerals used in this description relate to the annexed drawings wherein.

Figure 5:
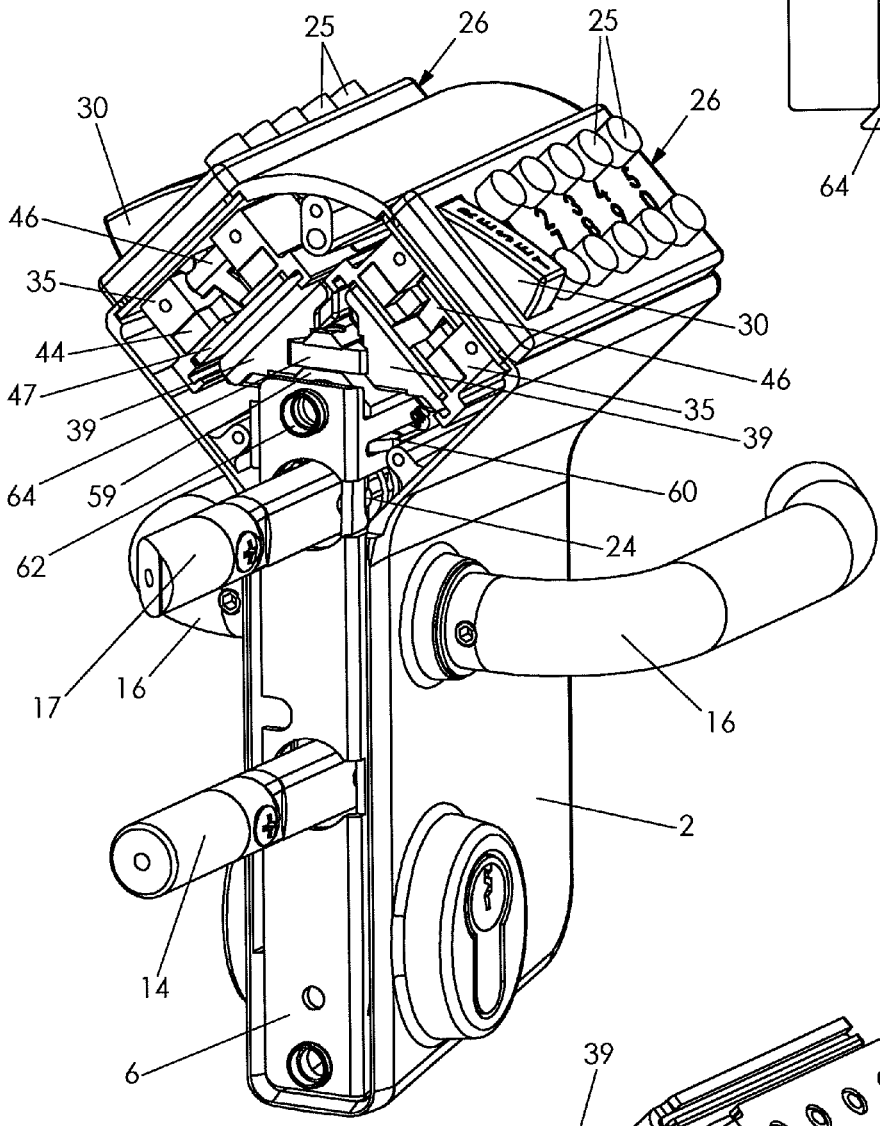
FIG. 5 shows a same view as FIG. 2 but having moreover a side element of the casing removed, the latch bolt being in its normal, locking position.
Figure 7:
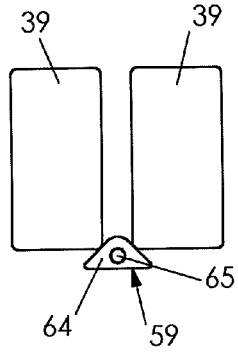
FIG. 7 shows a schematic top plan view on the first and second check slides and on the switching element of the selector in their position as illustrated in FIG. 6.
Figure 6:
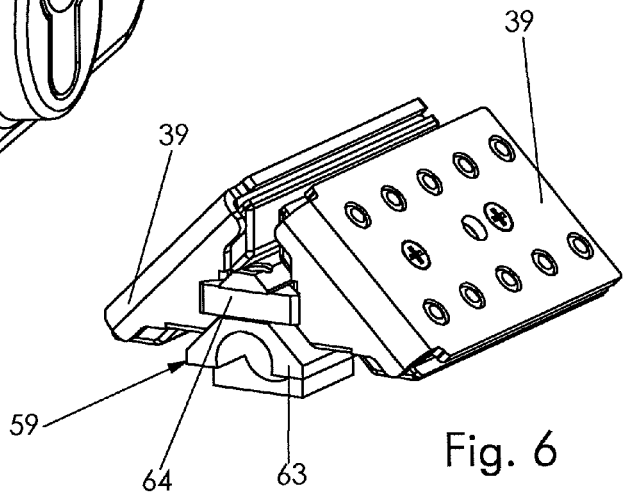
FIG. 6 shows, on a larger scale, the first and second check slides in their normal rest positions as in FIG. 5 and the selector engaging these check slides.
Figure 8:
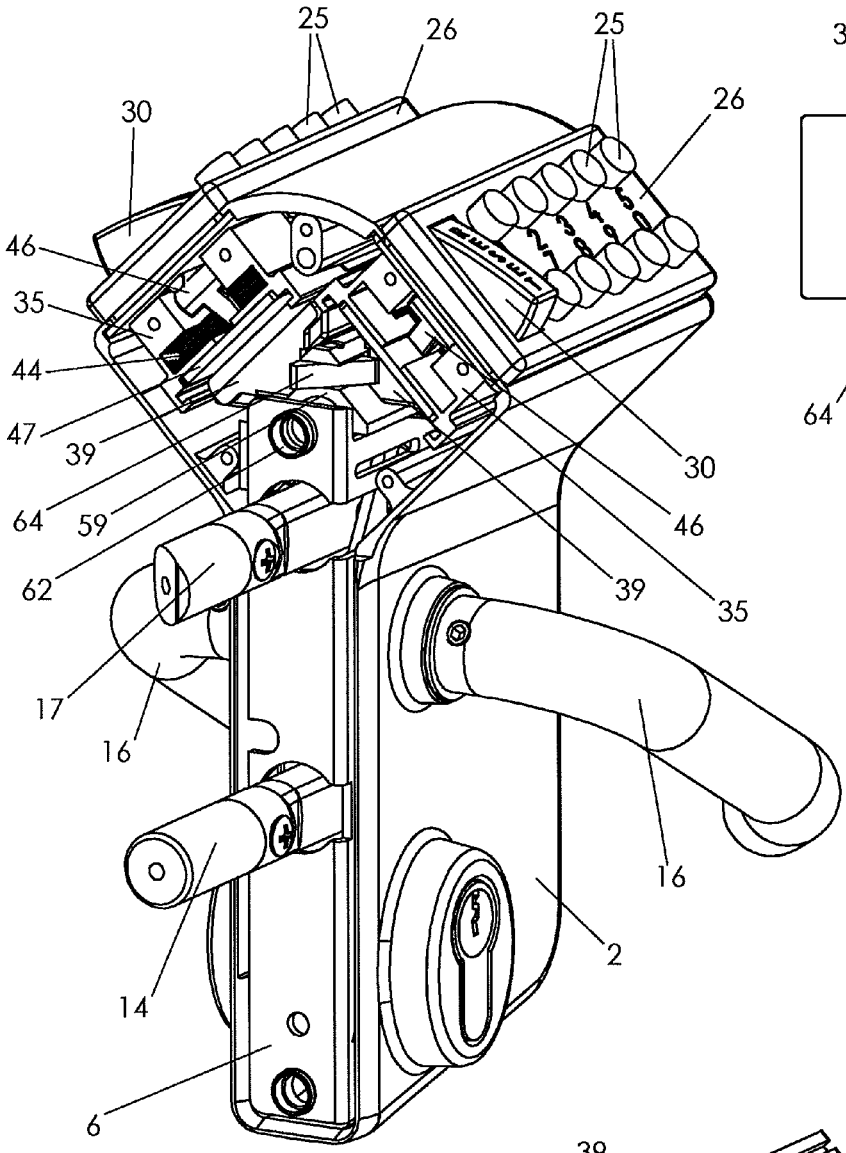
FIGS. 8 to 10 are the same views as FIGS. 5 to 7 but with the latch bolt moved by the handles to its retracted, unlocking positions and one of the check slides and the selector also moved to their retracted positions by the latch bolt actuating mechanism.
Figure 10:
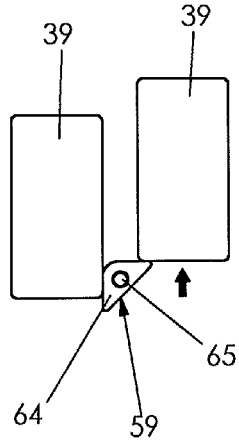
Figure 9:
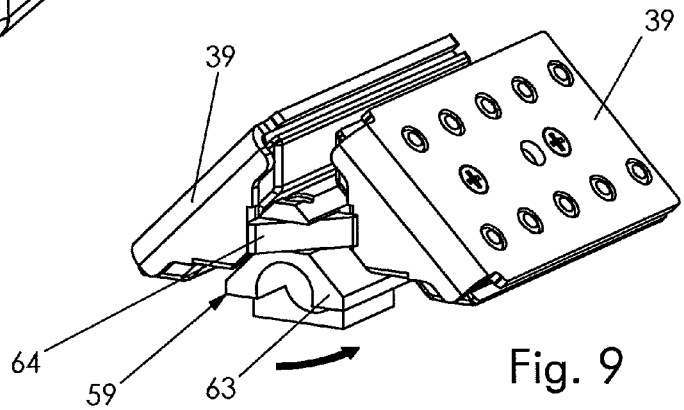
Figure 26:
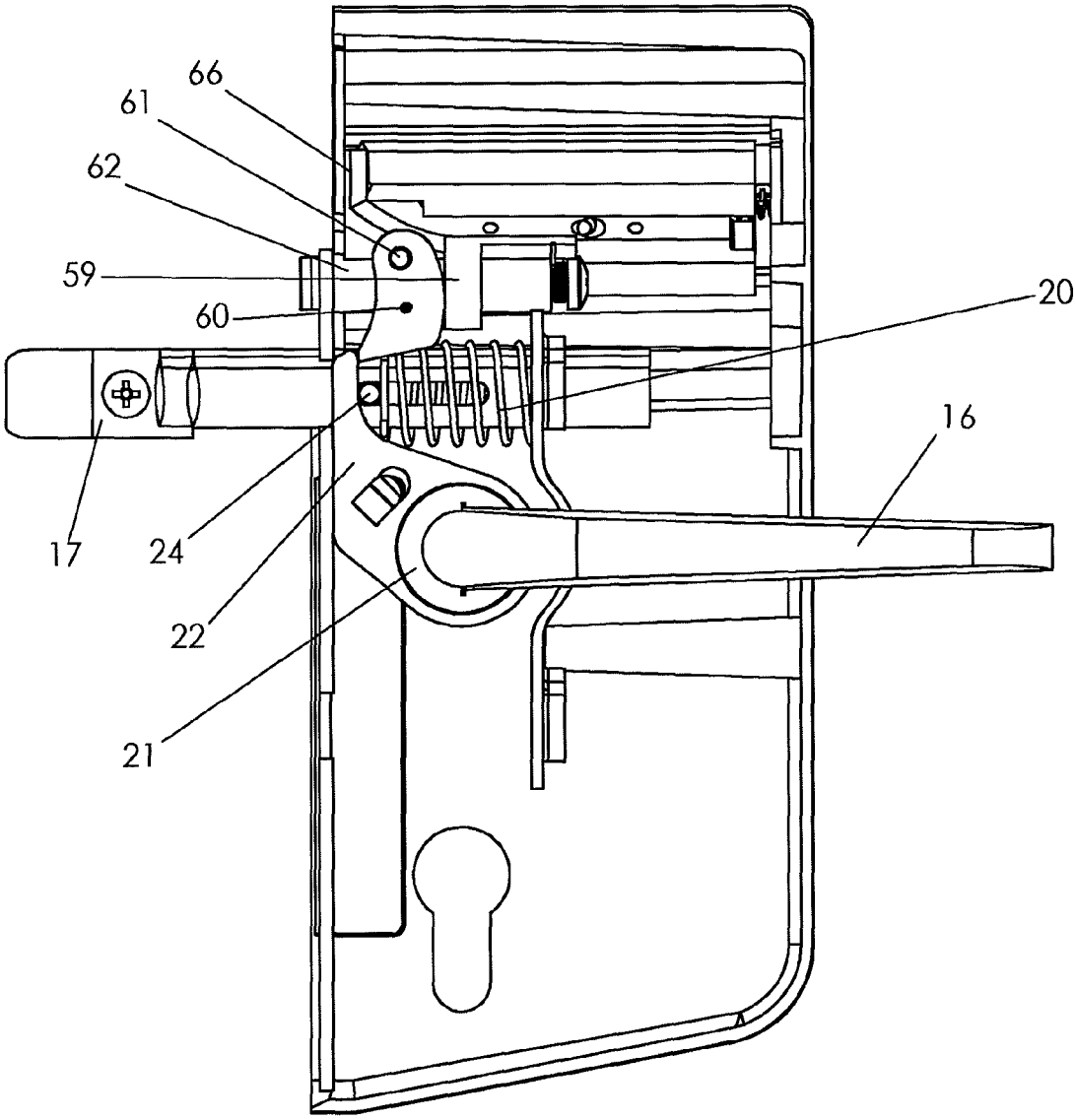
FIGS. 26 and 27 show schematically a side elevational view, with partial cutaways, of an alternative embodiment of the lock according to the invention, with the latch bolt in its extended and respectively in its retracted position.
Figure 27:
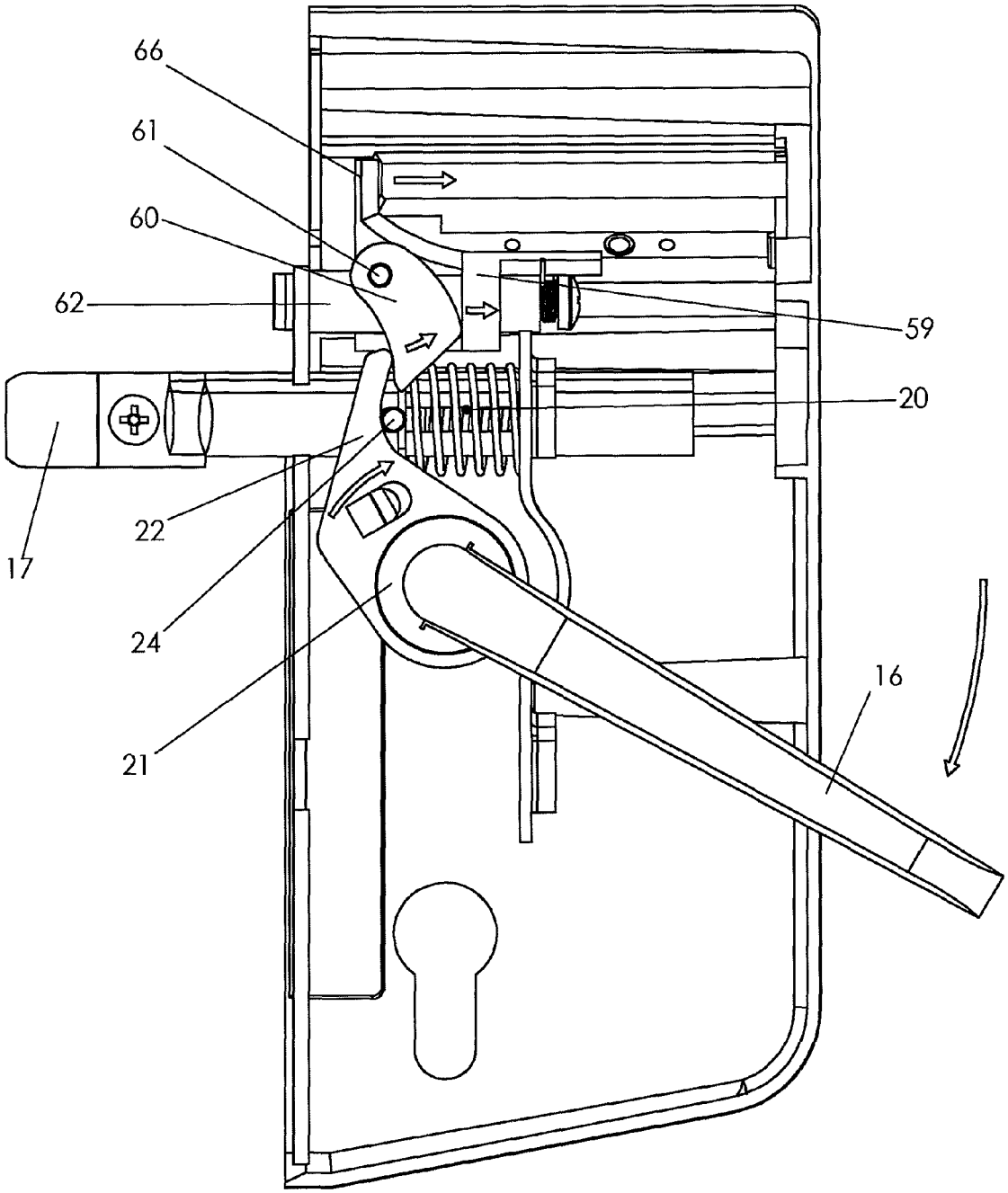
Figure 28:
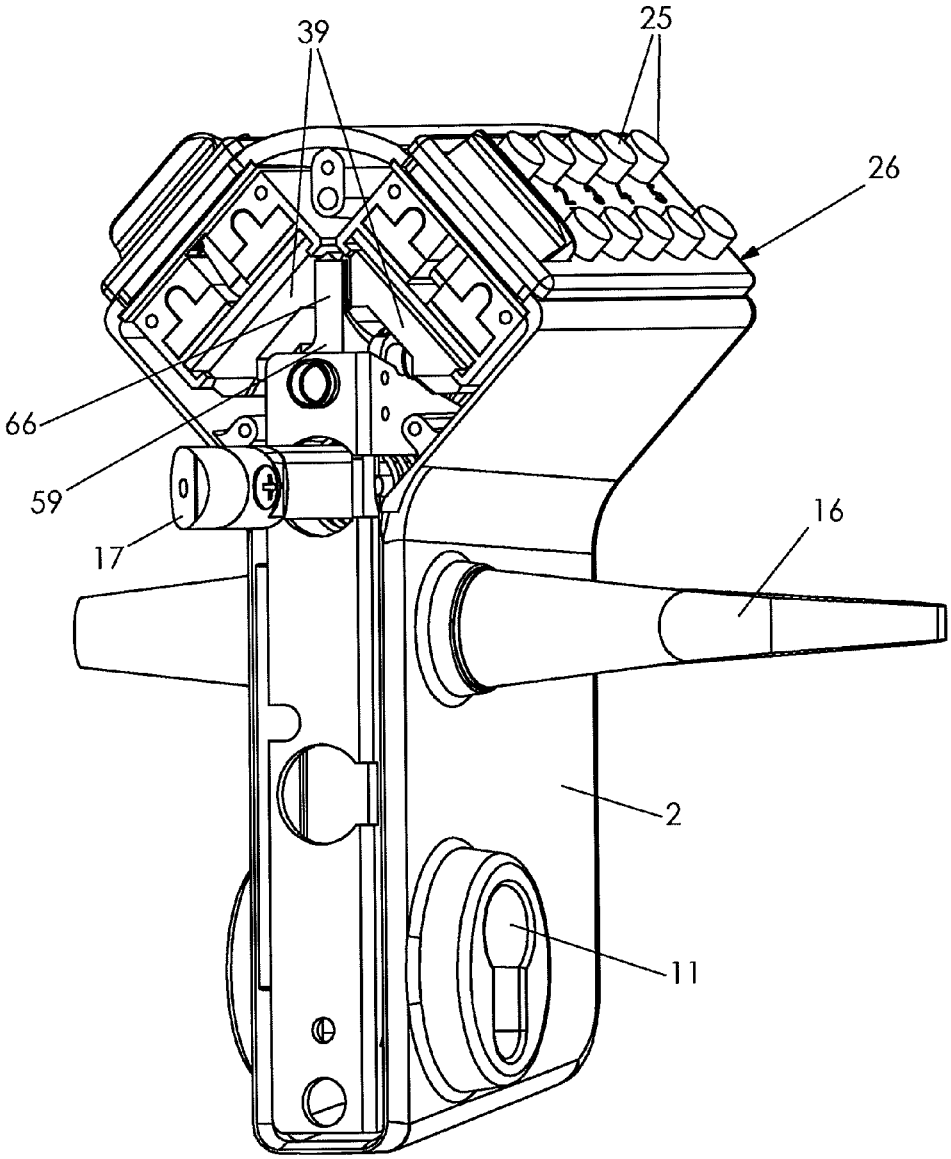
Figure 29:
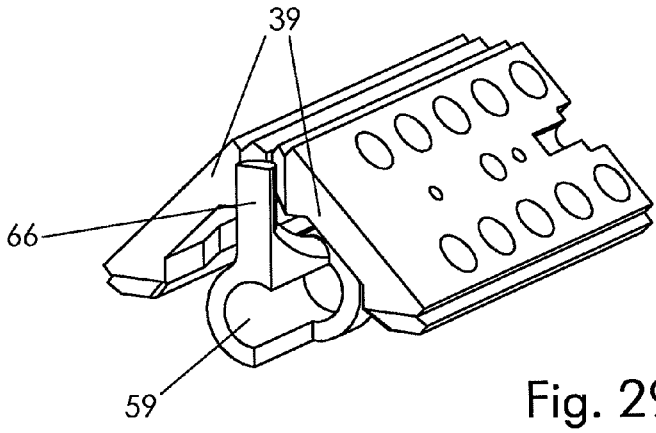
Figure 30:
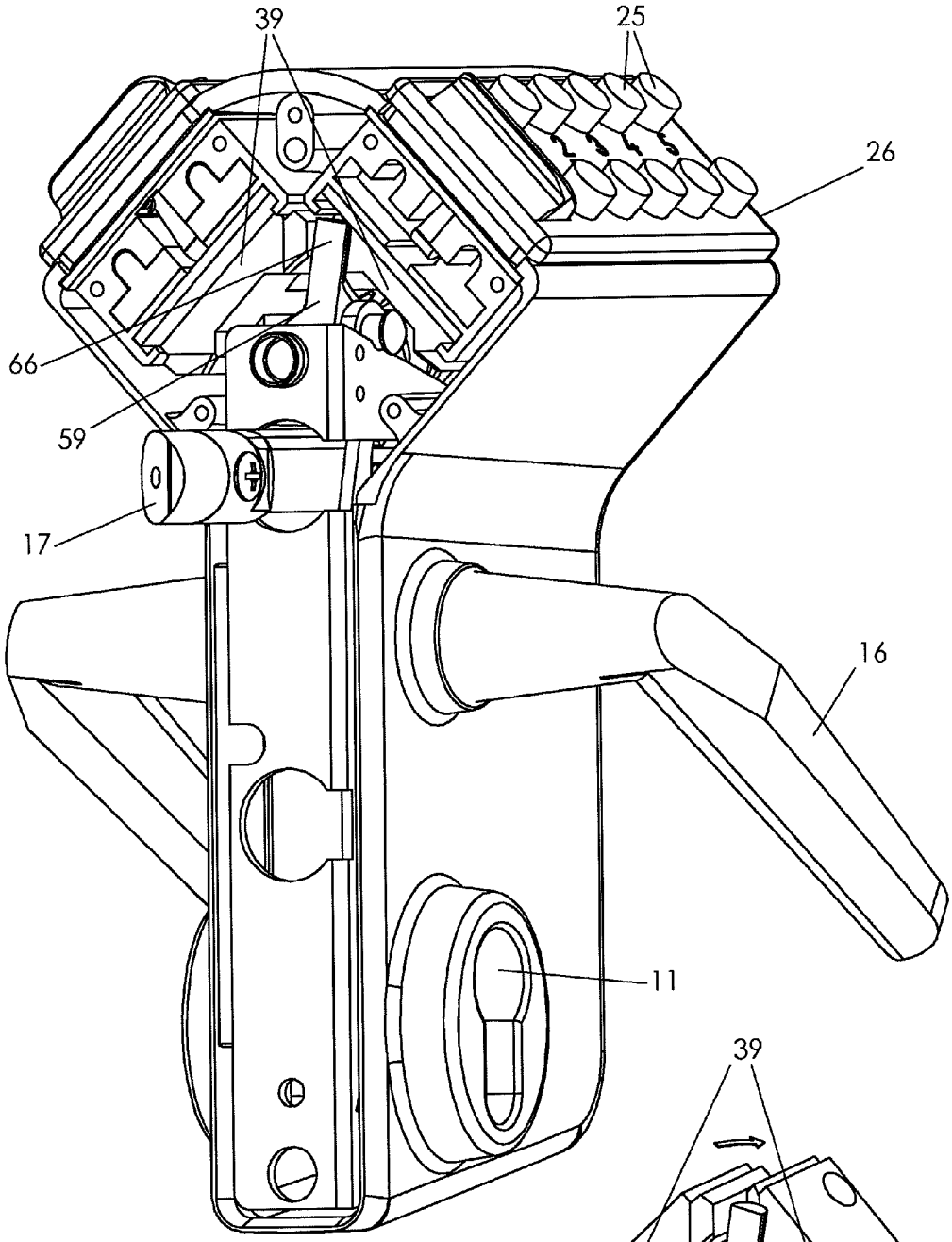
Figure 31:
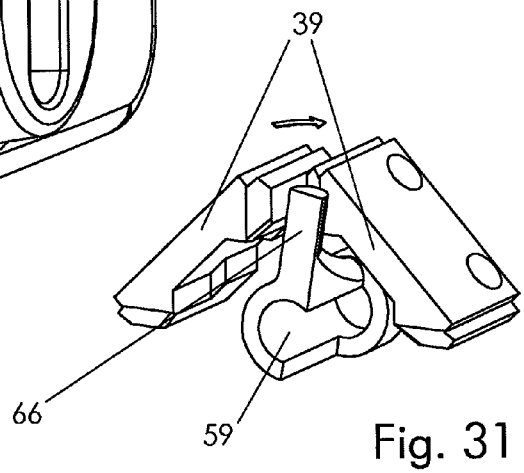
Figure 32:
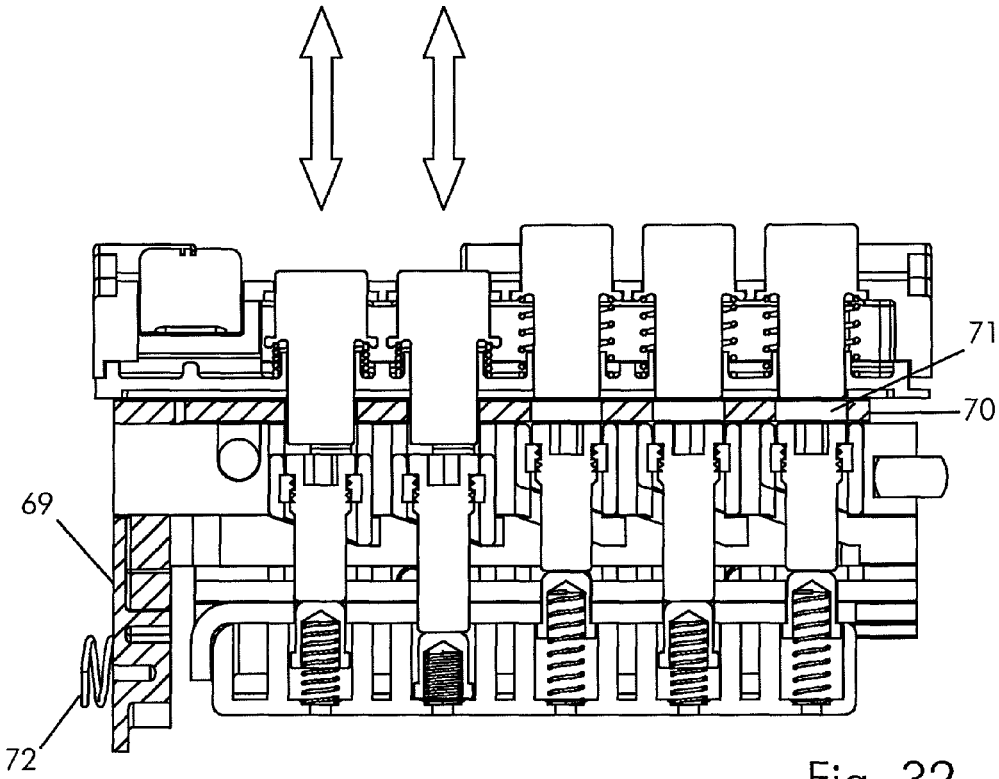
Figure 33:
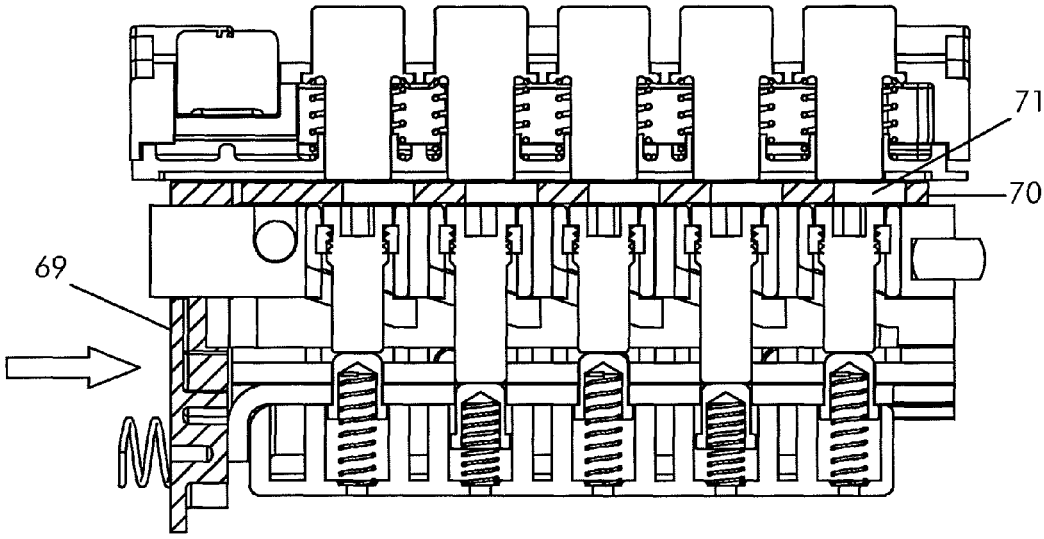
Figure 34:
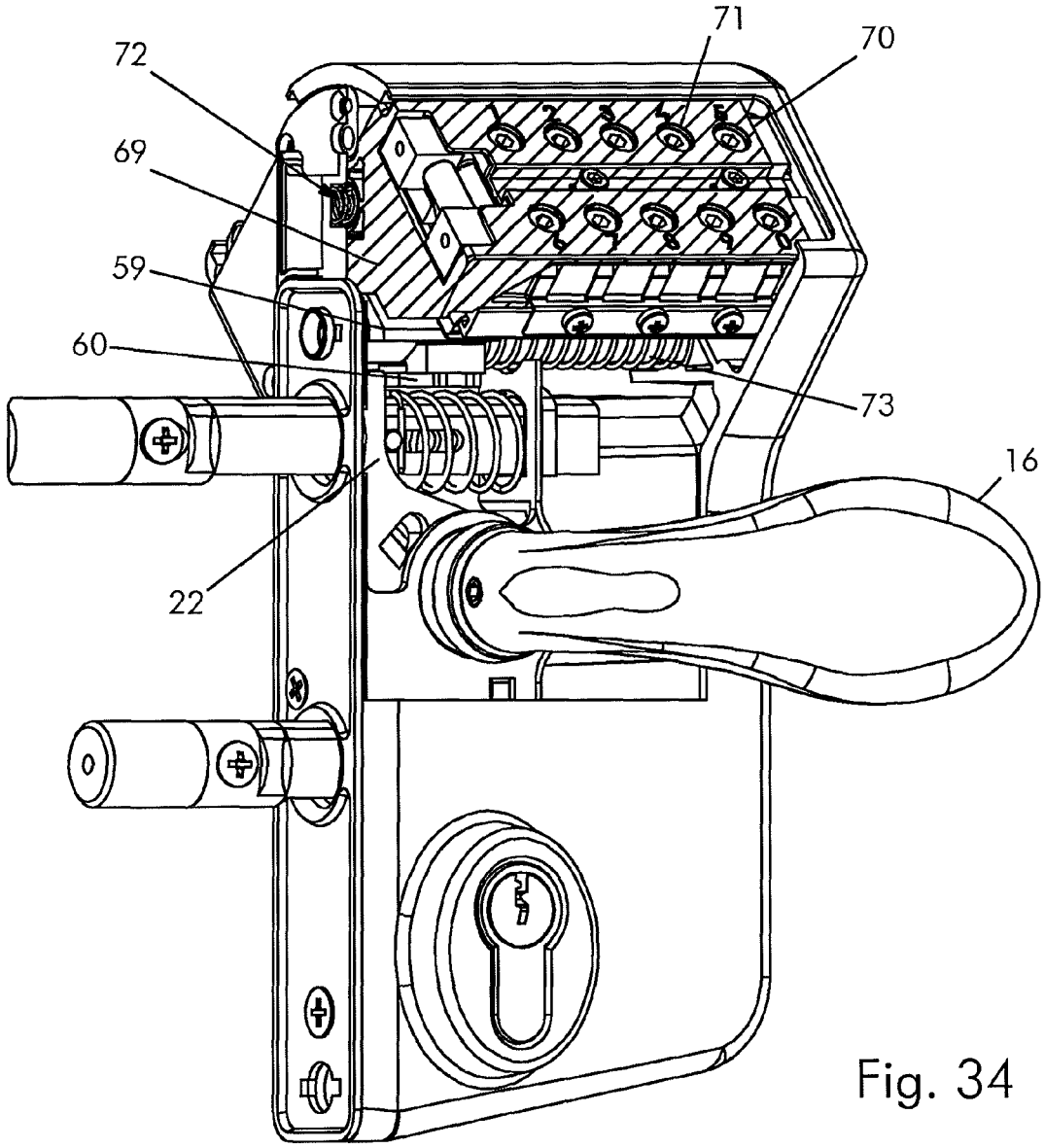
Figure 35:
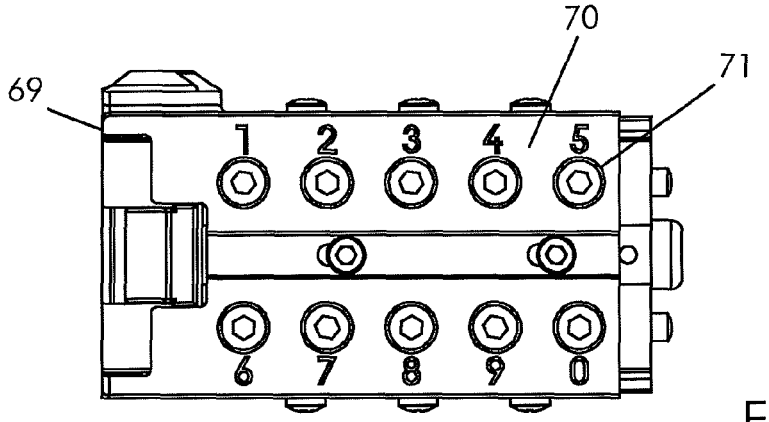
Figure 36:
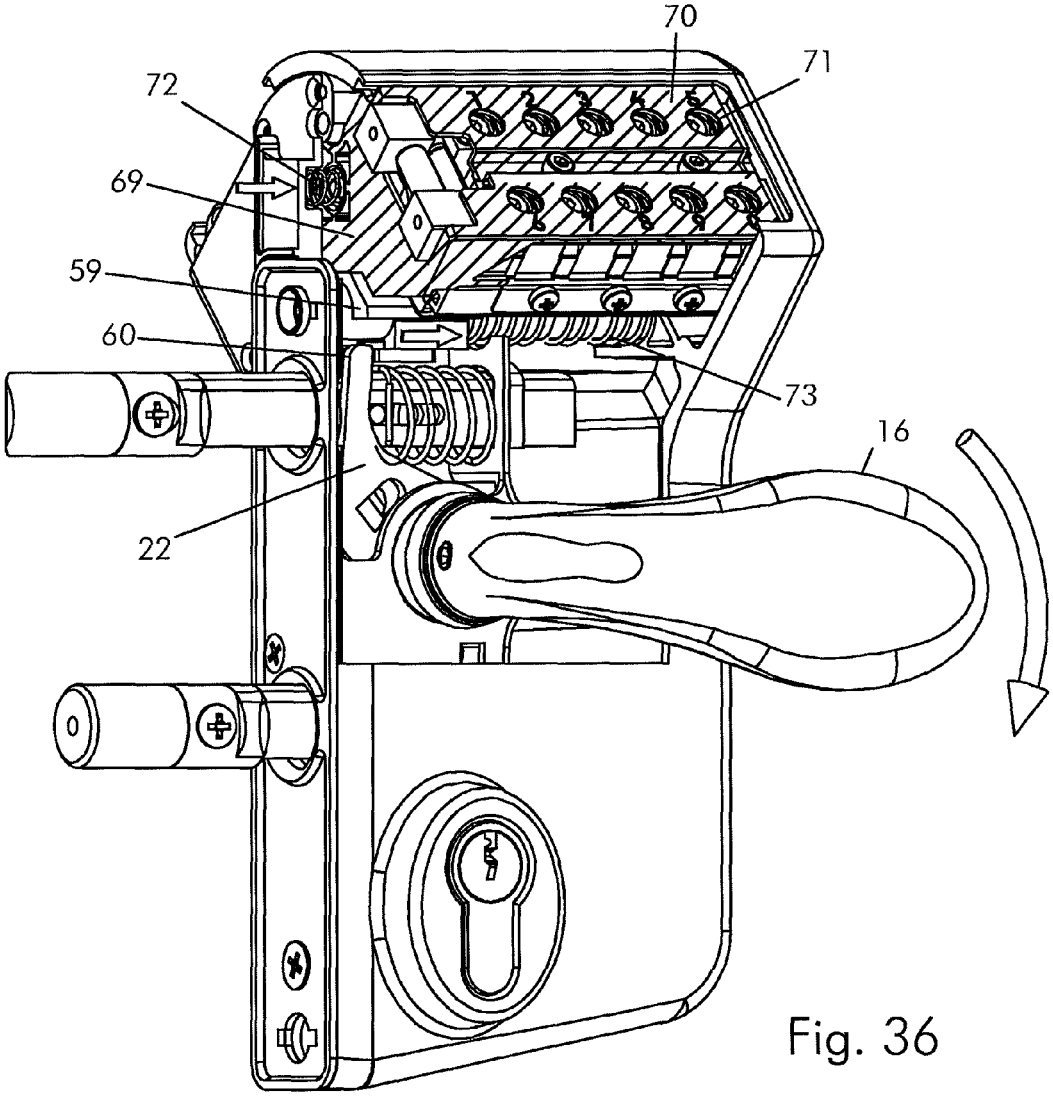
Figure 37:
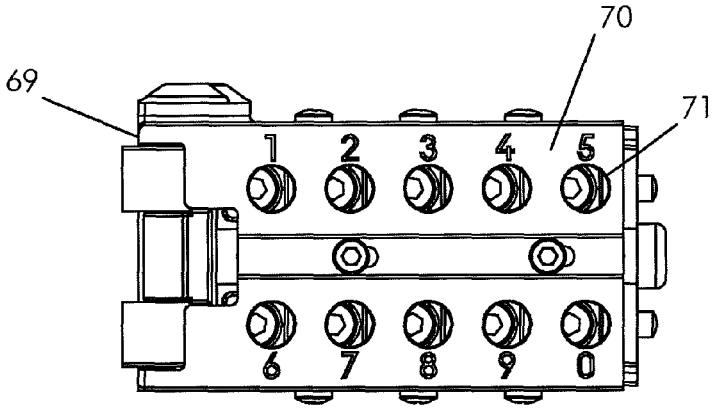

FIGS. 28 and 29 show a same view as FIGS. 5 and 6 but now of the lock illustrated in FIGS. 26 and 27;

FIGS. 30 and 31 show a same view as FIGS. 8 and 9 but now of the lock illustrated in FIGS. 26 to 29;

FIGS. 32 and 33 illustrate an alternative embodiment of the lock comprising a security slide, with sectional views through a portion of the lock at the location of one row of pushbuttons of one the keyboards with the security slide in the first and second position, respectively;

FIG. 34 shows a perspective view, with a partial cutaway, of the same alternative embodiment of the lock, with the security slide in the first position;

FIG. 35 shows a front view of the frame and tumbler members, with the security slide in the first position and the keyboard removed;

FIG. 36 shows a perspective view, with a partial cutaway, of the same alternative embodiment of the lock, with the handle partially depressed and the security slide in the second position;

FIG. 37 shows a front view of the frame and tumbler members, with the security slide in the second position and the keyboard removed.

The pushbutton combination lock shown in the drawings is a lock provided to be mounted against a profile, in particular a tubular profile, of a gate, fence, door, etc. The profile has to be provided with holes so that both the latch and the dead bolt can project there through. When the lock is mounted so that the latch and dead bolts do not have to extend through a profile, the length thereof can of course be reduced.

The lock illustrated in the figures comprises a frame 1 which includes as main structural elements a cover box 2, an upper 3 and a lower side cover plate 4 for closing the lateral side of the box 2 and a base plate 5 arranged within the closed box 2. The base plate 5 has on one side an upstanding edge 6 and on its other side two upstanding edge portions 7, 8. The upper side cover plate 3 is fixed by means of screws 9 to the upper portion of the cover box 2 whilst the lower, substantially rectangular side cover plate is fixed by means of a screw 10 to the cover box 2.

The cover box 2 is provided with two aligned openings 11 through which a cylinder 12 can be inserted in the lock, in particular a so-called Euro-cylinder corresponding to the standard DIN V18254/07.91. This cylinder 12 is fixed in the lock by means of a screw 13 passing through little holes made in the lower side cover plate 4 and in the upstanding edge 6 of the base plate 5. The cylinder 12 is a key actuated cylinder comprises a rotary driving bit which rotates around a central axis of the cylinder to actuate a dead bolt 14 of the lock. Since the mechanism for actuating a dead bolt 14 by means of a key actuated lock cylinder is well known, it has not been shown in the figures and will not be further described. Instead, reference is made to the description and the figures of EP-B-1 118 739 disclosing the key operated dead bolt actuating mechanism of the lock illustrated in the figures. The entire content of this European patent in included herein by reference.

Figure 11:
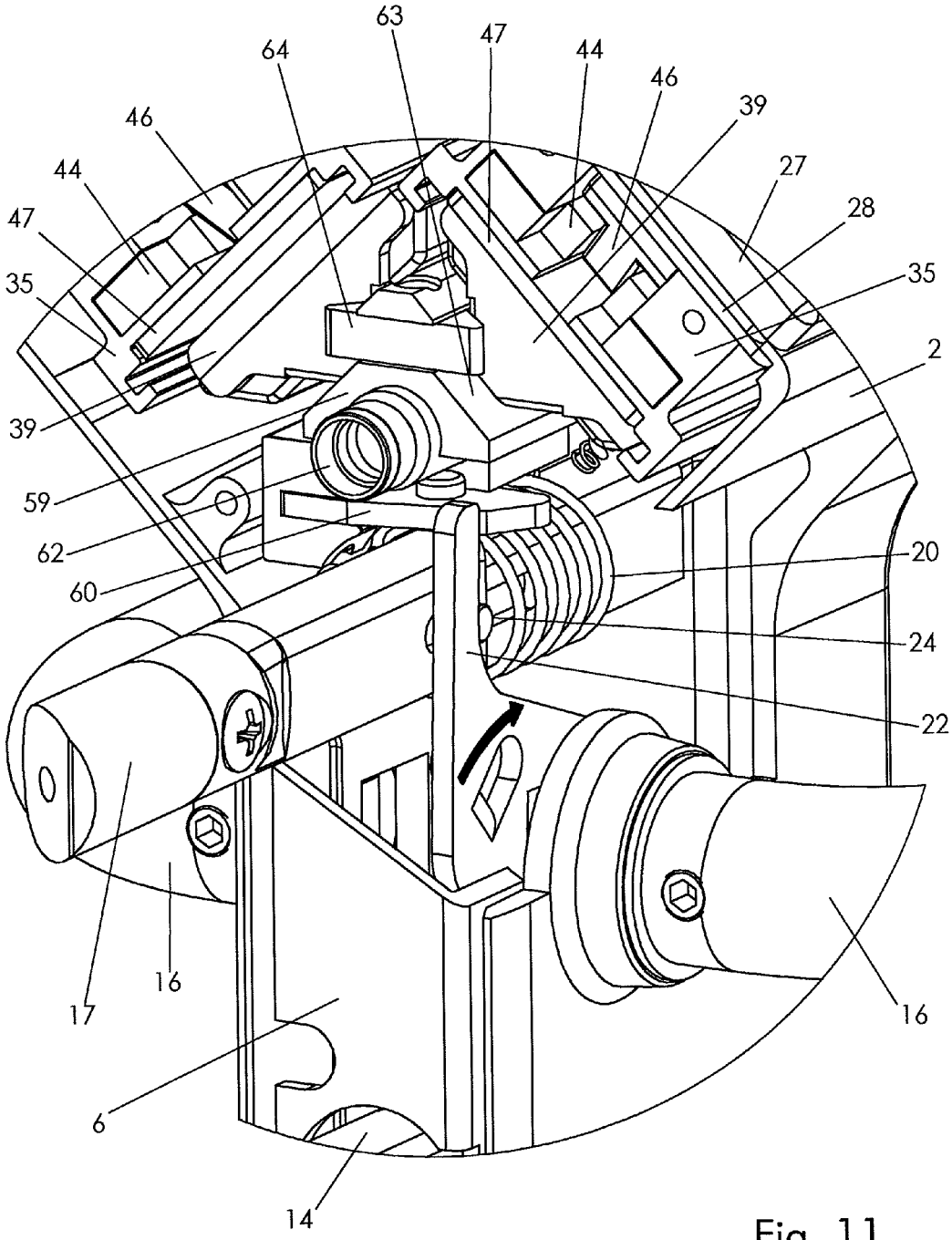
FIGS. 11 and 12 show, on a larger scale, a detail of FIGS. 5 and 8.
Figure 12:
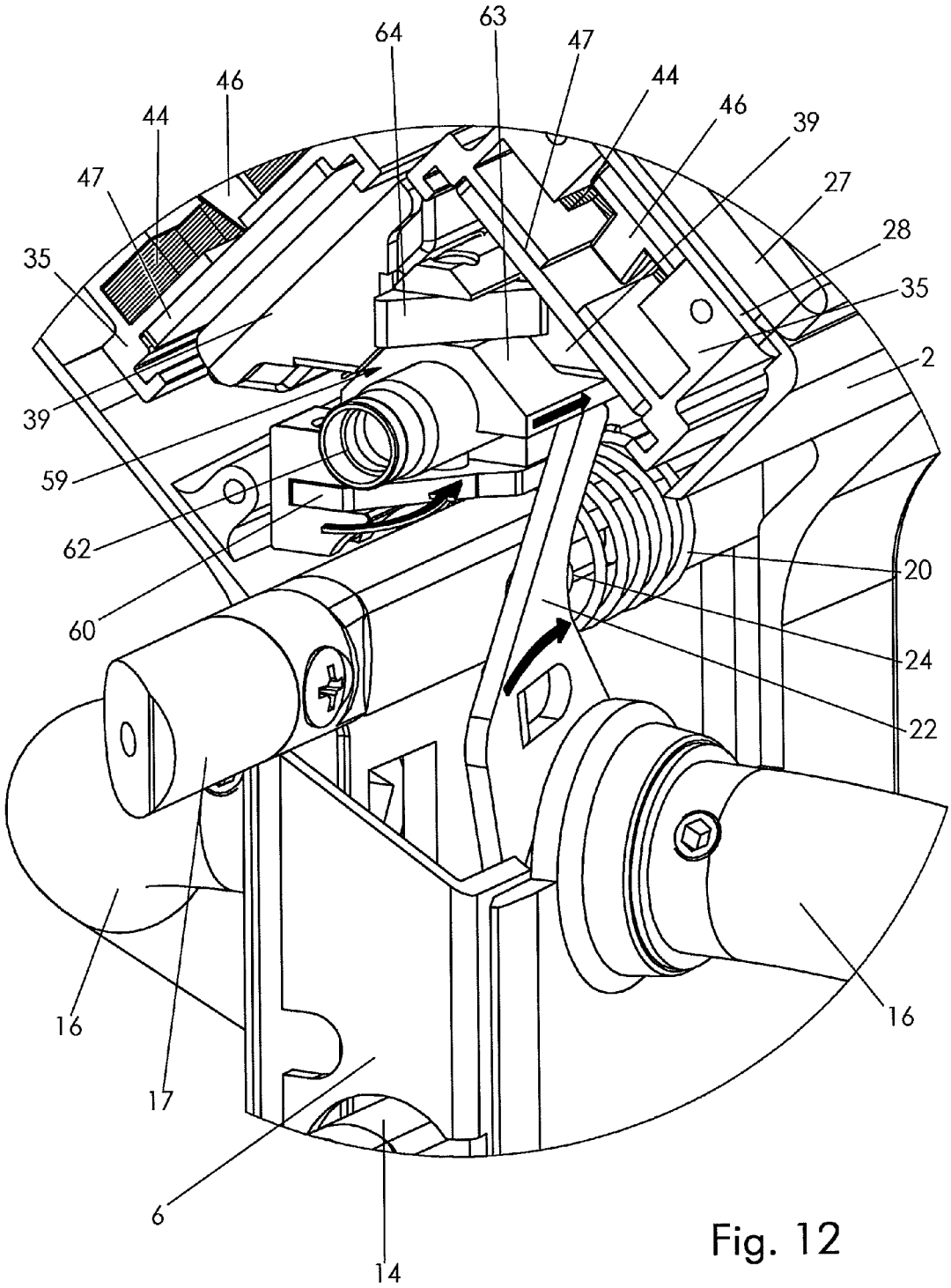

The cover box 2 is further provided with two additional aligned openings 15 through which the door handles 16 can be mounted to the lock. Both handles 16 are mounted onto one single square handle shaft so that both handles always move simultaneously. The illustrated lock further comprises a lock bolt 17 which is operated by means of the handles 16 to move it between a locking (see FIG. 11) and an unlocking position (see FIG. 12). The bolt 17 is in particular a latch bolt which is slidably mounted on the frame 1 of the lock, more particularly within an opening 18 in the upstanding edge portion 7 and an opening 19 in the upstanding edge 6 of the base plate 5. The latch bolt 17 can thus move between a projecting position shown in FIG. 11 and a retracted position shown in FIG. 12. A compression spring 20 is applied over the latch bolt 17 to urge this bolt to its projecting position. For bringing the latch bolt 17 by means of the handles 16 to its retracted position, the rectangular handle shaft is inserted in a corresponding hole in a follower 21 (see FIG. 21). This follower 21 is provided in its turn with a latch bolt lever 22 which follows the rotations of the handles 16 and which engages the latch bolt 17 against the action of a torsion spring 23 to retract this latch bolt. The torsion spring 23 serves to push the latch bolt lever 22 and thus the follower 21 and the handles 16 to their initial rest positions. Further details about the latch bolt actuating mechanism can be found in EP-B-1 118 739, in particular also about a second turn lever which enables to retract the latch bolt by means of the key operated cylinder.

The distance over which the latch bolt and the dead bolt of the lock illustrated in the figures projects out of the lock is adjustable due to the fact that the latch bolt and the dead bolt are provided with a projection 24 which is slidably mounted in the bolt and which can be displaced in the bolt through the intermediary of a set screw. For more details about this adjustment mechanism, reference is again made to EP-B-1 118 739, the entire content of which is incorporated herein by reference.

An essential difference between the lock disclosed in EP-B-1 118 739 and the lock illustrated in the figures is that the lock according to the invention comprises a pushbutton operated locking mechanism for locking the lock bolt, in particular the latch bolt. When locked by this mechanism, the latch bolt can still be moved to its retracted position when closing the door or gate, i.e. when pushing it in against the latch bolt spring 20, or, when a second turn lever is provided, by means of a second turn of the key operated cylinder 12. The locking mechanism thus functions to prevent the lock bolt from being moved by the lock bolt actuating mechanism to its retracted or unlocking position.

Figure 22:
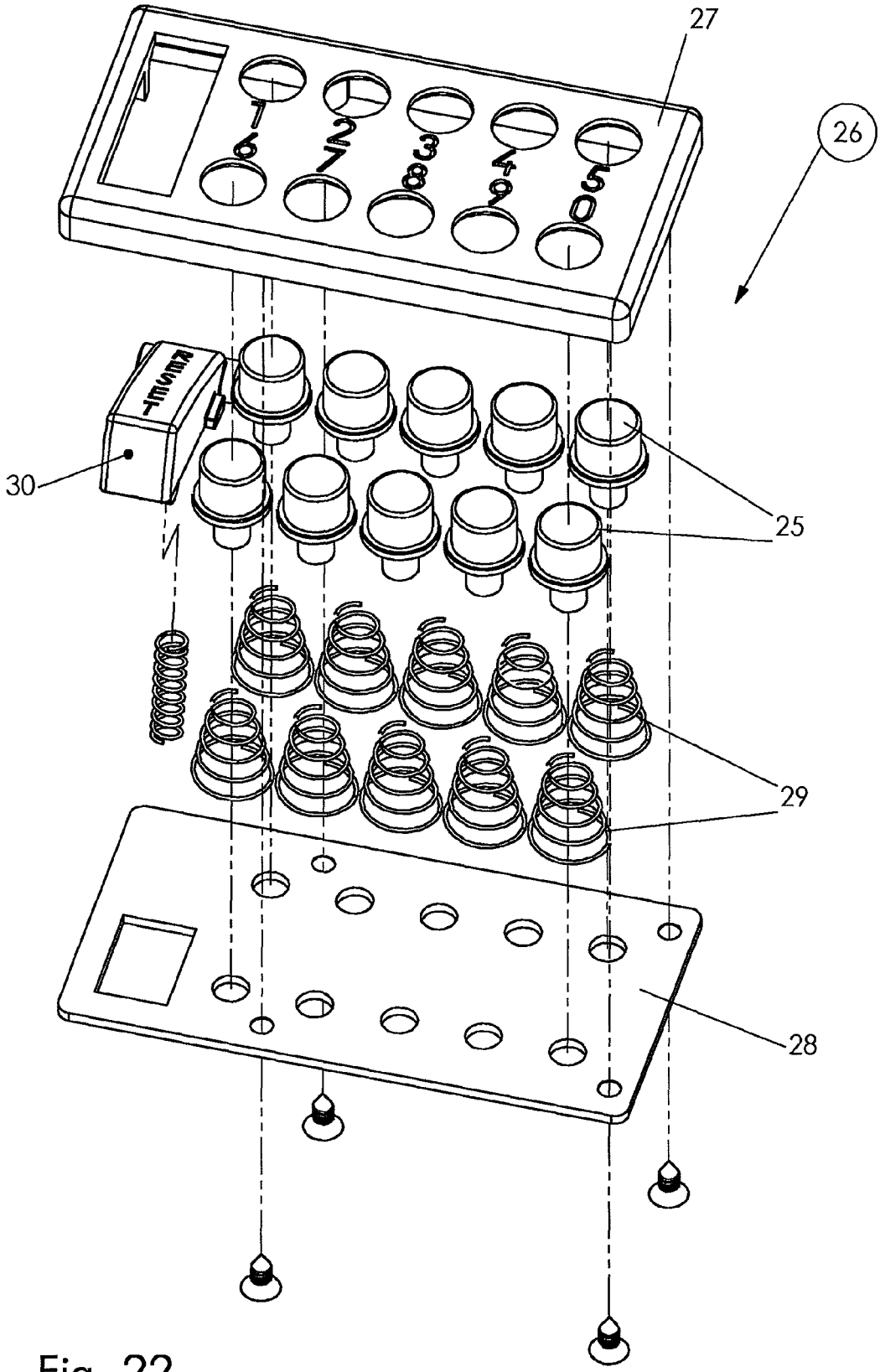

The locking mechanism comprises a first series of pushbuttons 25 on the front side of the lock and a second series of pushbuttons 25 on the back side of the lock. As illustrated in FIG. 22, the pushbuttons 25 are integrated in a keyboard 26 which comprises an upper lid portion 27 and a base plate 28 screwed against the upper lid portion to form a cavity for the pushbuttons. The pushbuttons 25 have head portions urged by means of springs 29 through openings out of the upper lid portion 27 and stem portions which extend through openings through the base plate when the pushbuttons 25 are pushed in. The keyboard 26 also comprises a reset button 30.

Figure 1:
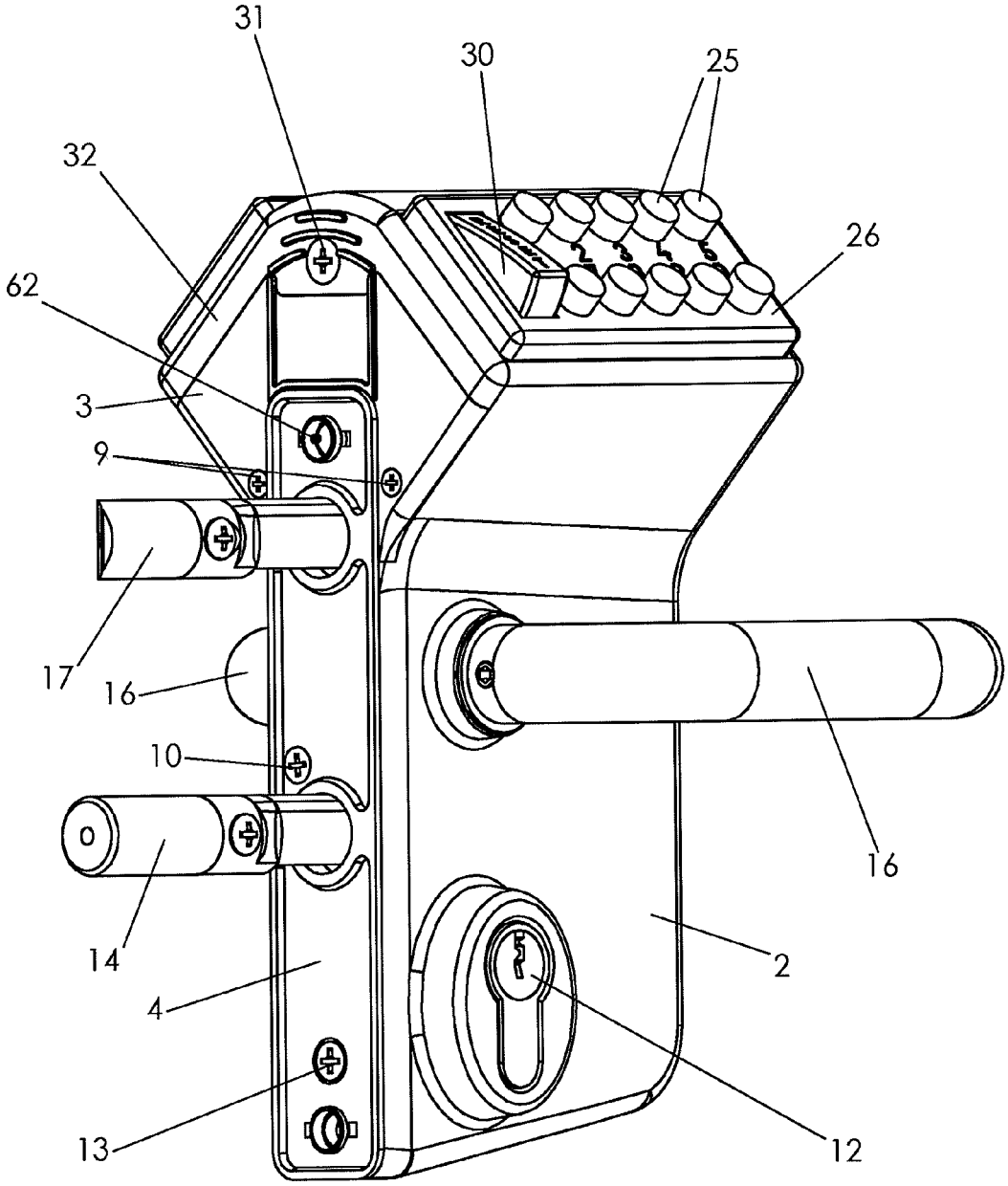
FIG. 1 shows a perspective view of a pushbutton combination lock according to the present invention.
Figure 2:
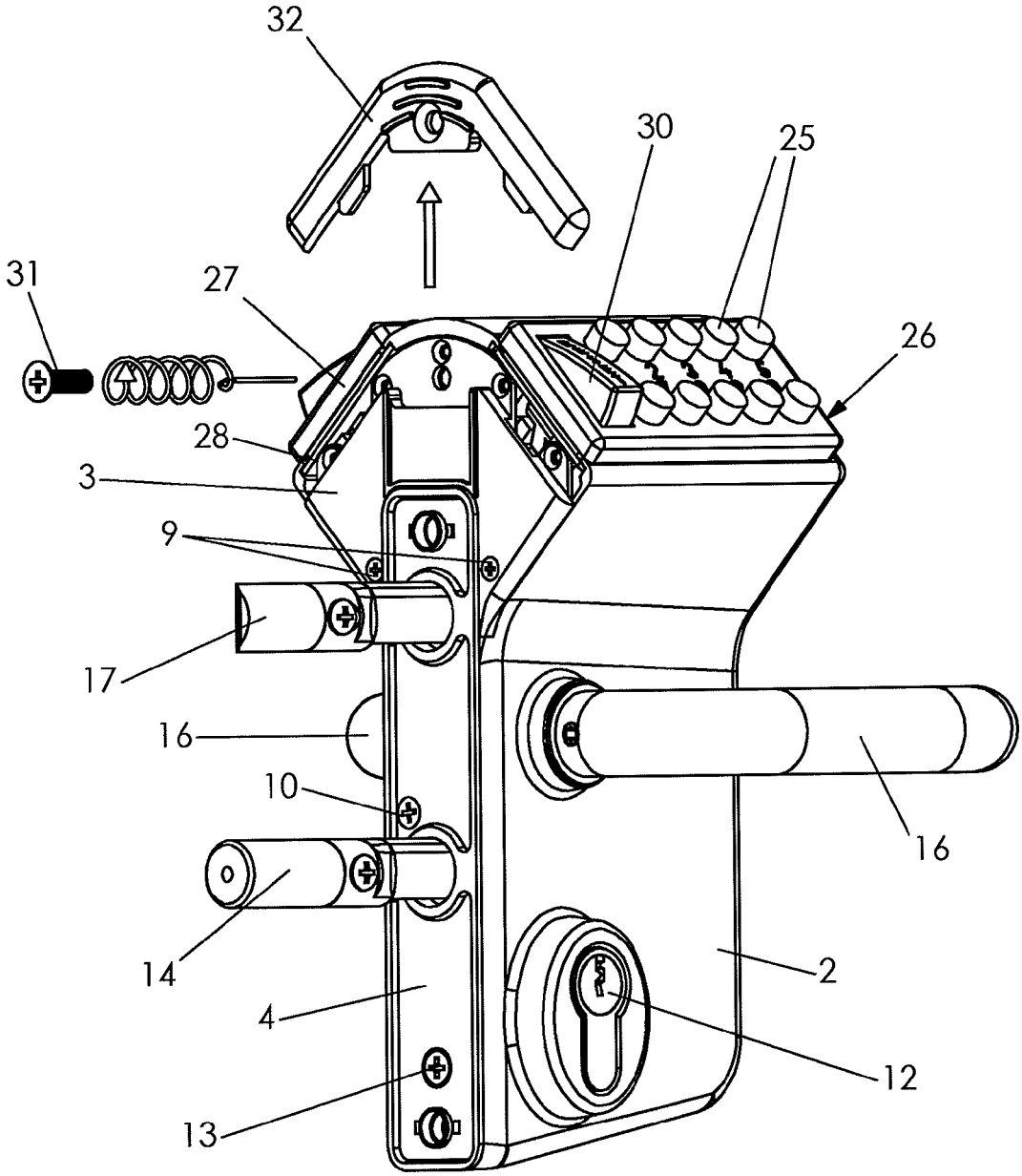
FIG. 2 shows a same view as FIG. 1 but with the retaining element of the keyboard removed.
Figure 3:
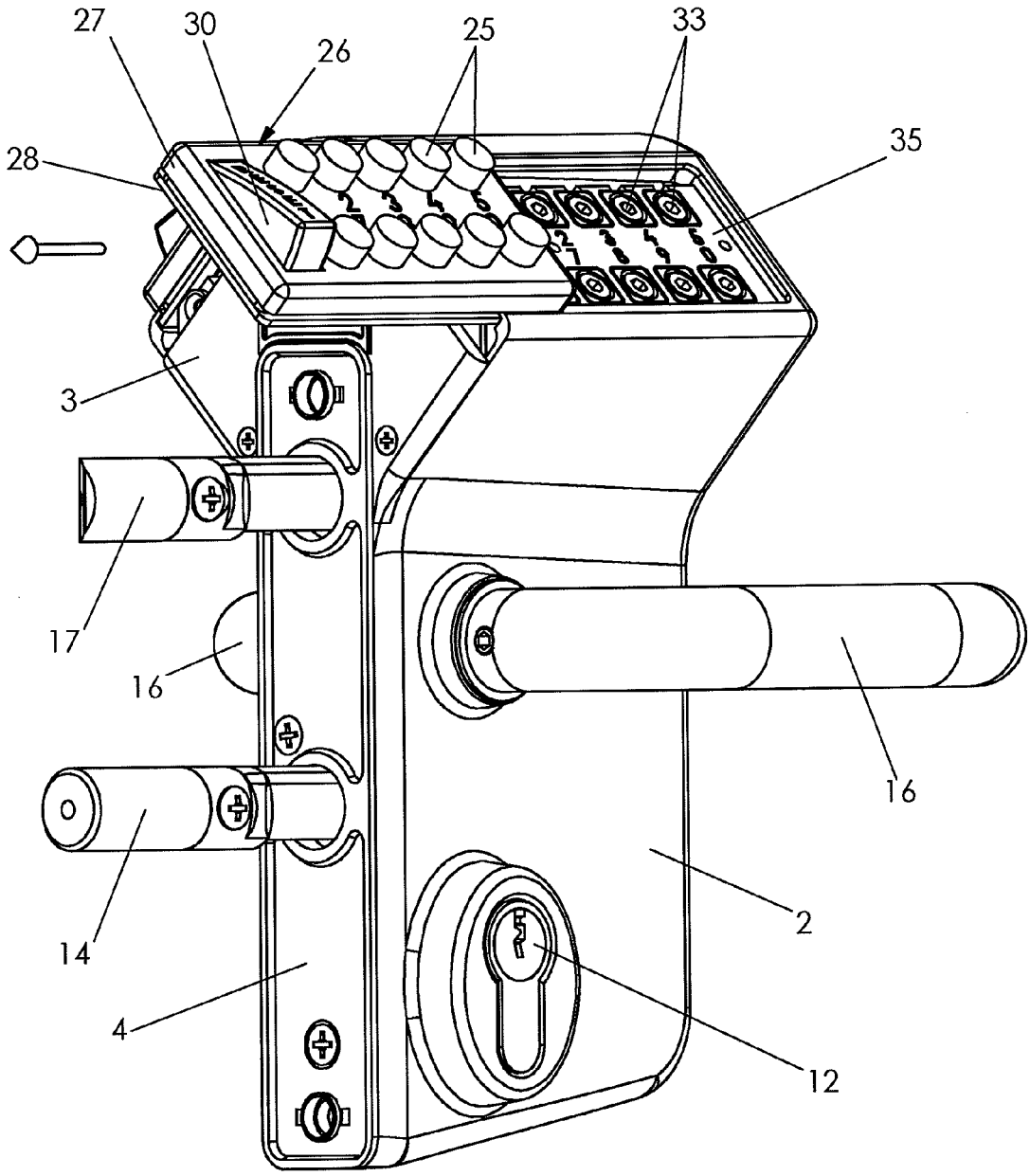
FIG. 3 shows a same view as FIG. 2 but illustrates the removal of the keyboard.

The keyboards 26 have a circumferential groove by means of which they can be slid each in an upper, rectangular opening in the cover box 2. By means of a retainer element 32, which is fixed by a screw 31 to the lateral side of the lock, the keyboards 26 are prevented from being removed from the lock. As illustrated in FIGS. 2 and 3, the keyboards 26 can however be easily removed from the lock after having removed the retainer element 32.

Figure 20:
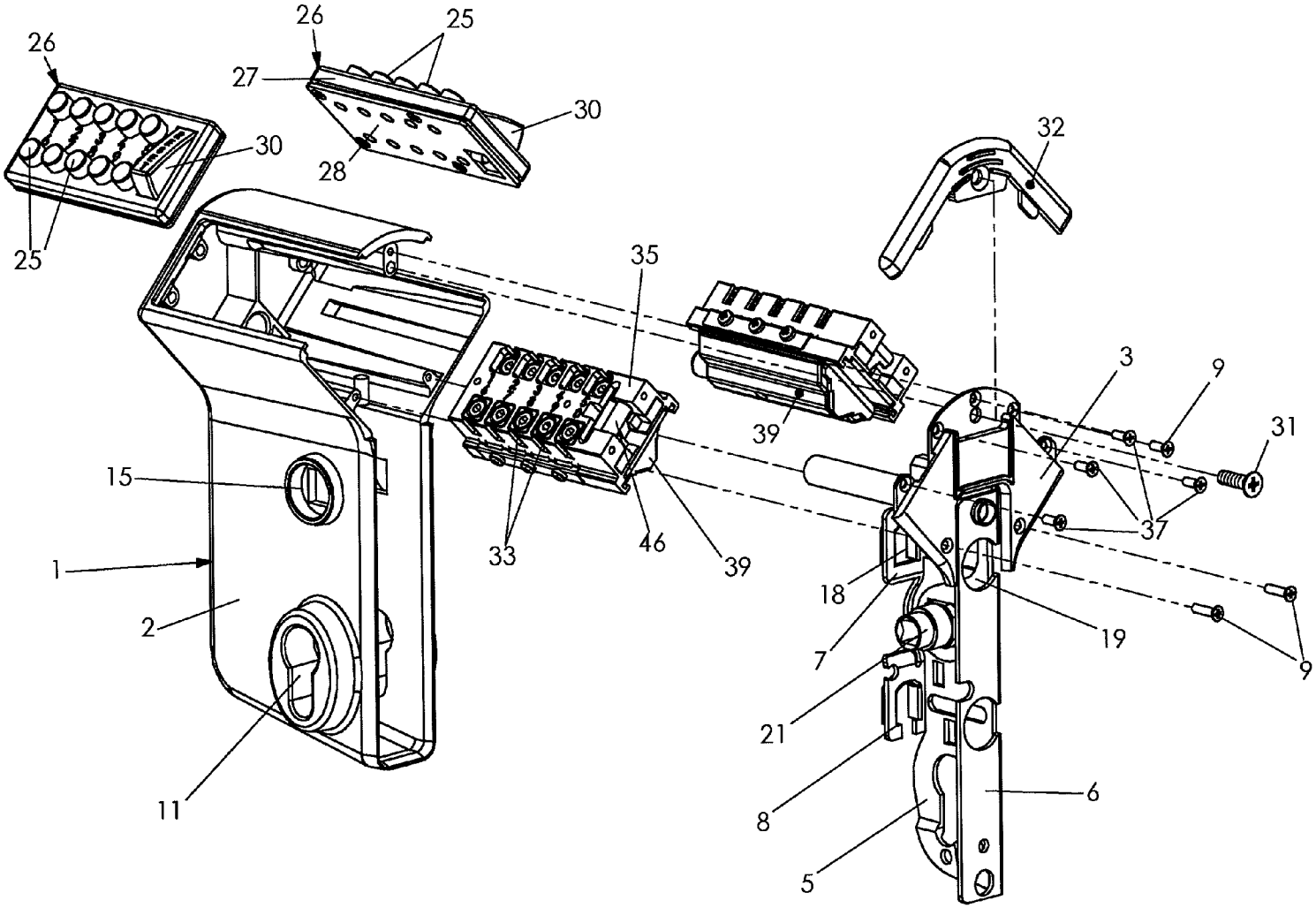
FIG. 20 shows in an exploded view the main components of the lock illustrated in the previous figures, the latch bolt, dead bolt and latch bolt and dead bolt actuating mechanism having been omitted for clarity's sake.

The locking mechanism further comprises two series of tumbler members 33, namely a first series of tumbler members which are movable between normal and depressed stable positions by means of the first series of pushbuttons 25 and a second series of tumbler members which are movable between normal and depressed stable positions by means of the second series of pushbuttons 25. The tumbler members 33 are arranged, on the one hand, in holes 34 in a frame component 35 which is fixed by means of pegs 36 and screws 37 to the cover box 2 and, on the other hand, in holes 38 in two check slides 39 which are slidably mounted on the frame component 35 (see FIGS. 20 and 23). Depending on the positions of the tumbler members 33, the check slides 39 are either blocked or released with respect to the frame component 35.

The tumbler members 33 each consist of a first tumbler element, composed of a base body 40 and a code body 41, and a second tumbler element 42. The base bodies 40 are slidably mounted in the holes 34 in the frame component 35. To be held in the two stable positions, the base bodies 40 each have two recesses on one lateral side which can be engaged by a spring detent 43, more particularly by leaf springs fixed against both sides of the frame component 35 and extending through slits therein into the holes 34. Instead of leaf springs, it is also possible to use spring detents comprising compression springs.

The code bodies 41 are of two different lengths and are removably fixed to the base bodies 40 to extend through axial holes provided therein. The code bodies 41 can for example be snapped in the holes in the base bodies 40. However, in the preferred embodiment illustrated in the drawings, the code bodies 41 are in the form of screws which can be screwed easily and reliably into the base bodies 40.

To enable to reset the tumbler members 33 after being depressed by the pushbuttons 25, i.e. in order to enable to return the tumbler members 33 to their normal stable position, a reset slide 44 is provided in each of the frame components 35. This reset slide 44 is biased by means of a spring 45 to its rest position and can be moved by depressing of the reset button 30, through the intermediary of a lever 46, against the spring bias. The reset slide 44 is provided with oblique cam surfaces (forming a kind of saw tooth) engaging an oblique bottom surface of the base bodies 40 to lift the tumbler elements 40, 41 to their normal positions when the reset slide 44 is moved against the spring bias. At the underside the frame component 35 comprises a bottom plate 47 which is fixed to the main part of the frame component by means of screws 48. The bottom plate 47 is provided with openings 49 which are part of the holes 34 in the frame component 35 and which are arranged to receive and guide the lower extremities of the code bodies 41.

The check slides 39 are guided on the frame components 35 along the bottom plates 47 and comprise a main body part 50, forming part of the holes 38 for slidably receiving the second tumbler elements 42, and a top plate 51 fixed by means of screws 52 to the main body part 50. The top plate 51 shows openings 53 which are part of the holes 38 in the frame component 35 and which are arranged to receive and guide the second tumbler elements 42. These second tumbler elements 42 are more particularly biased by means of springs 54 to project out of the openings 53 until a flange on the second tumbler elements 42 engages the top plate 51.

The check slides 39 are biased by means of springs 55 to their first or rest position. In that position the openings 49 in the bottom plate 47 (forming part of the holes 34 in the frame component 35) and the openings 53 in the top plate 53 (forming part of the holes 38 in the check slides 39) are situated opposite one another so that the second tumbler elements 42 are biased by means of the springs 54 against the first tumbler elements, more particularly against the code bodies 41 thereof. At least one of the first tumbler elements 40, 41 is a code tumbler element, which comprises a "short" code body 40 so that the corresponding second tumbler element 42 extends into the hole 34 in the frame component 35 to block the check slide 38 when all the tumbler members have been reset. The first tumbler elements 40, 41 may also comprise (and will normally comprise) one or more block tumbler elements, which comprise a "long" code body 40 having such a length that, in the reset position of the tumbler members, they push the corresponding second tumbler elements 42 into the holes 38 in the check slides 39, without projecting themselves into these holes 38. The block tumbler elements therefore do not block the reset slides when they are not depressed but they do block the reset slides when being depressed.

Figure 13:
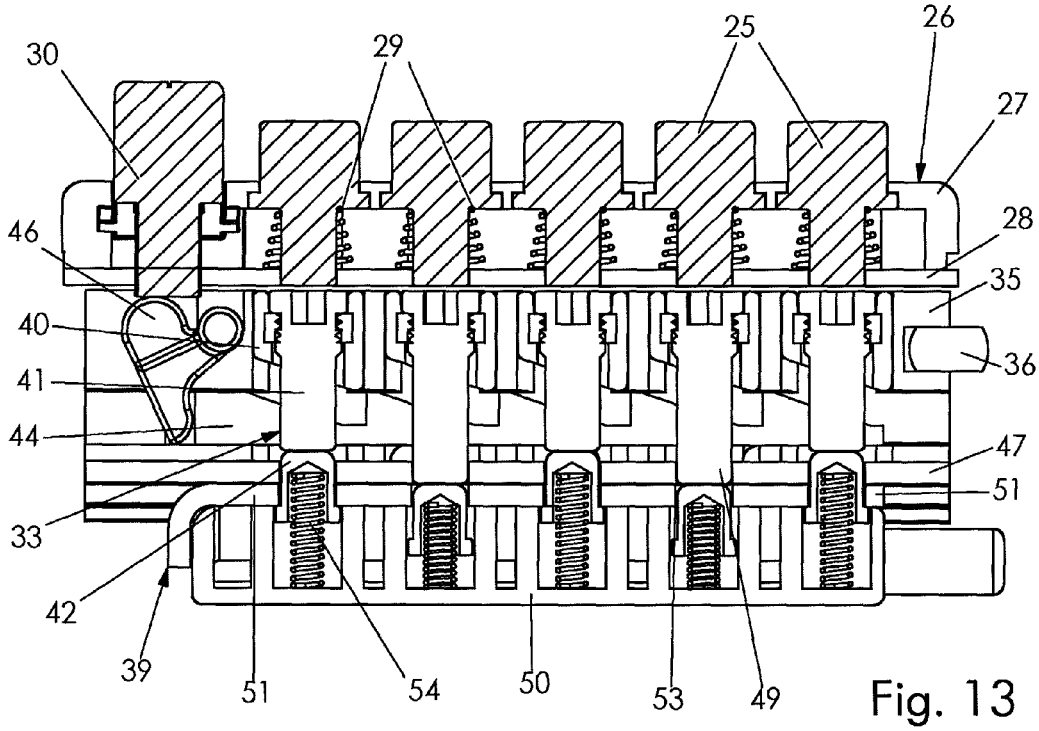
FIG. 13 shows a cross-sectional view through a portion of the lock at the location of one row of pushbuttons of one the keyboards, and the tumbler members and the check slide co-operating therewith, the tumbler elements being all in their reset or normal positions.
Figure 14:
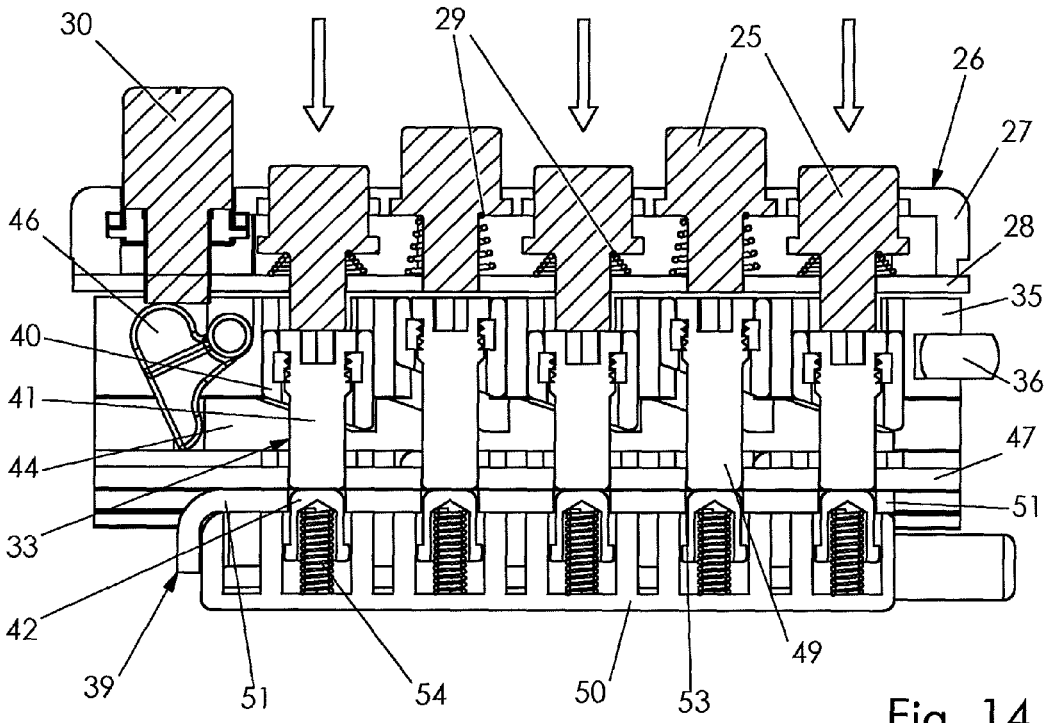
FIG. 14 illustrates the depressing of the code tumbler elements by means of the pushbuttons to release the check slide and to unlock thereby the lock.
Figure 15:
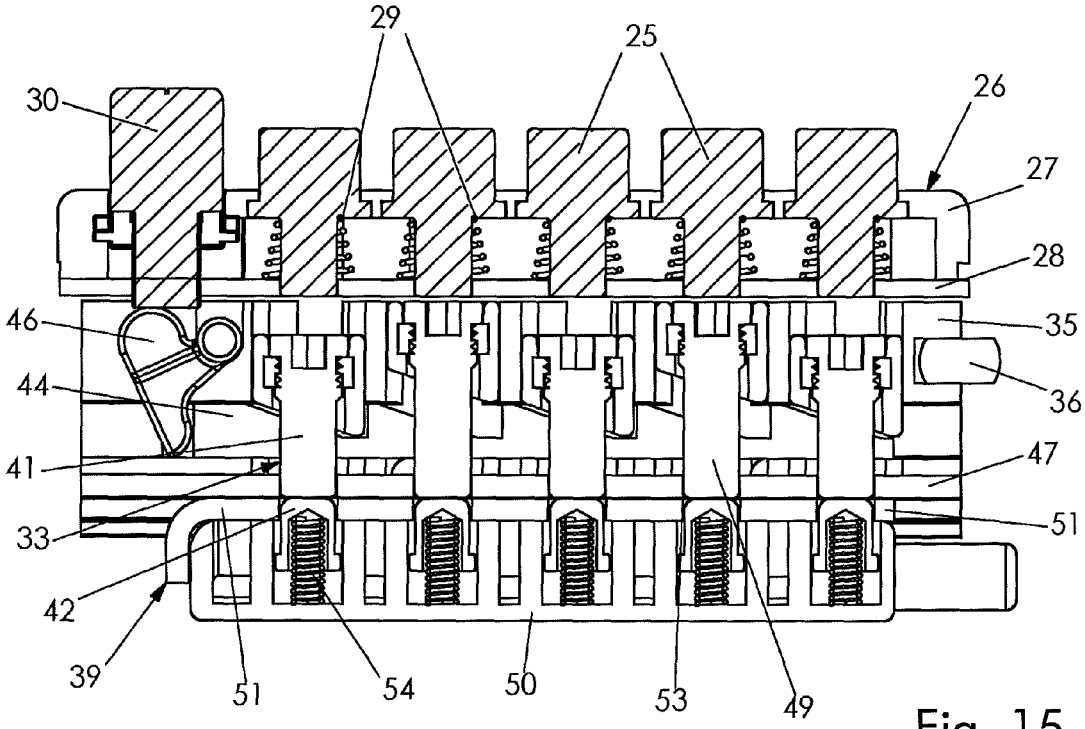
FIG. 15 illustrates the released check slide with the pushbuttons returned to their normal positions.
Figure 17:
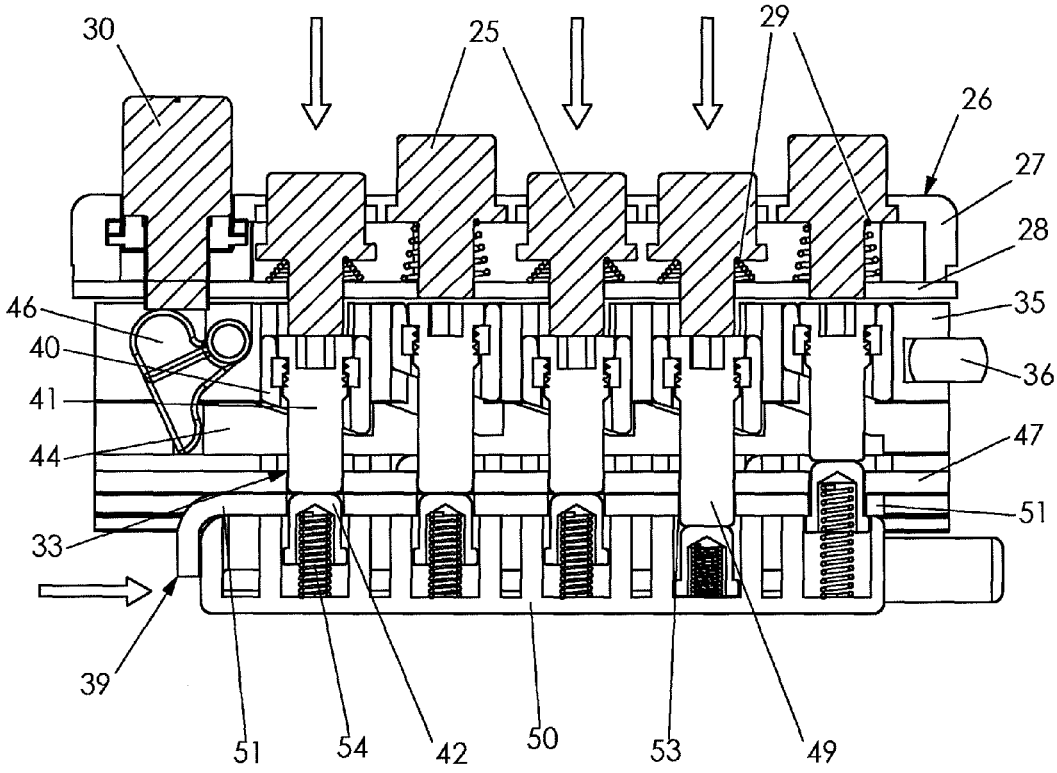
FIG. 17 illustrates the check slide blocked by means of a first and second tumbler element after having used a wrong number combination.
Figure 18:
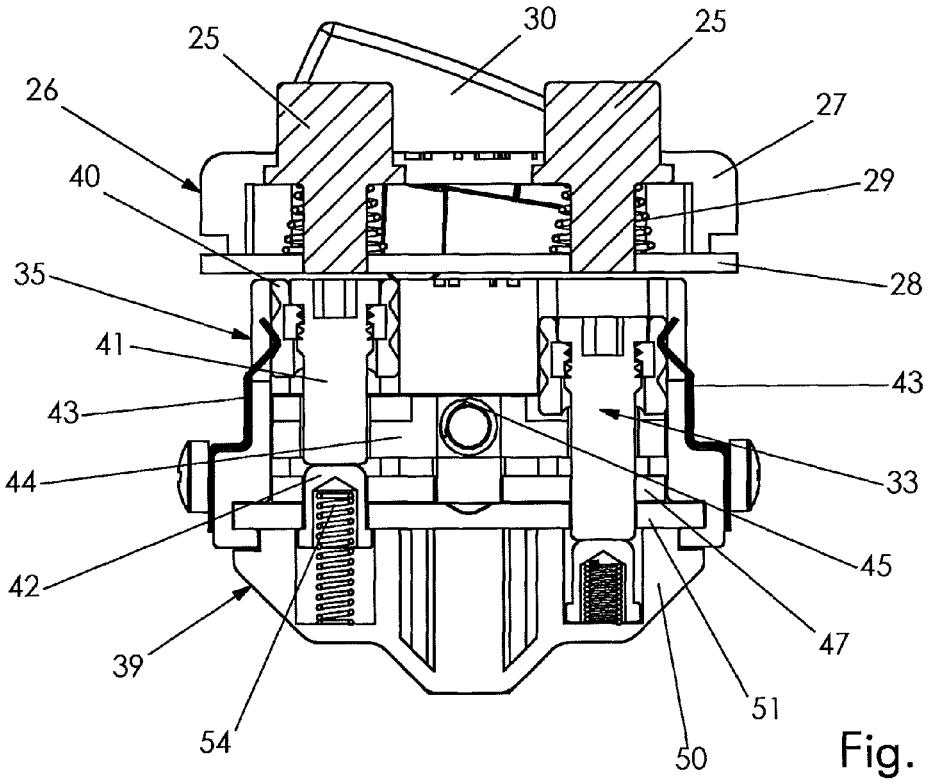
FIG. 18 shows a cross-sectional view through a same portion of the lock as in FIGS. 13 to 17 but taken in a direction perpendicular thereto.
Figure 19:
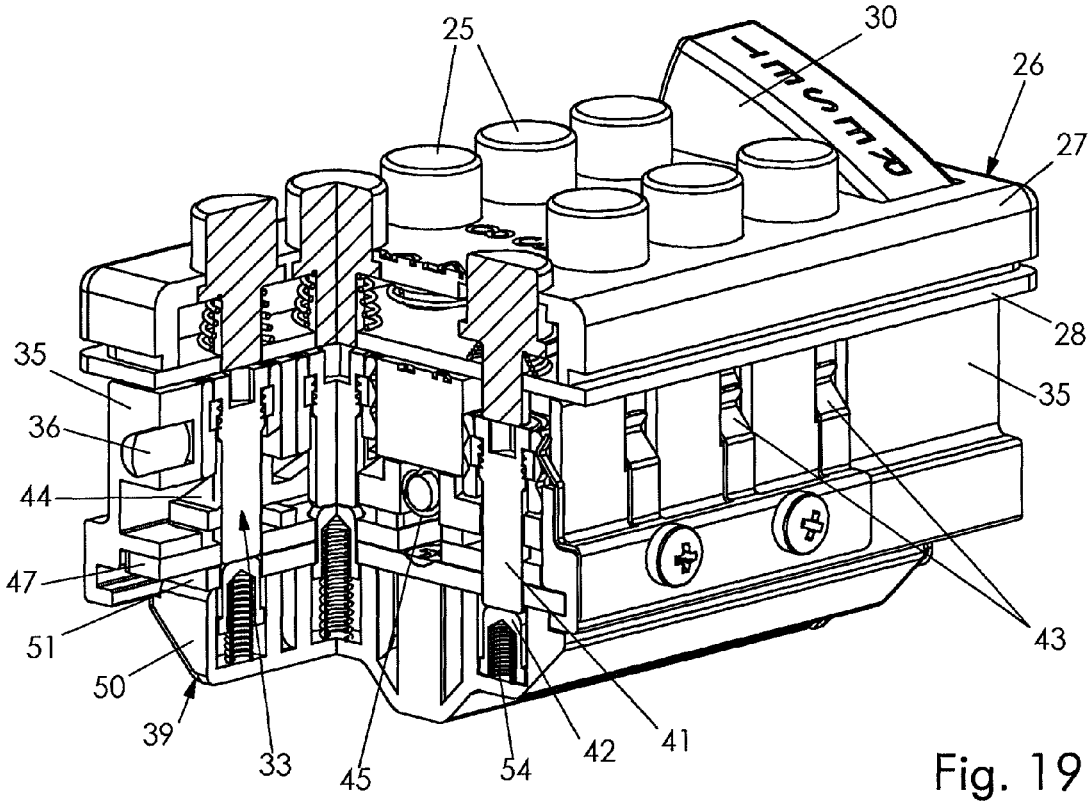
FIG. 19 shows a perspective view, with a partial cutaway, of a same portion of the lock as in FIGS. 13 to 18.

The blocked position of the check slide 39 when all of the tumbler members 33 have been reset is illustrated in FIG. 13. As can be seen in FIG. 14, the check slide 39 can be released by depressing only the code tumbler elements by means of the respective push buttons 25. Since the pushbuttons 25 return immediately back to their rest position when being released, the number combination required to release the check slide cannot be seen from the outside when the check slide has been released (see FIG. 15). As can been seen in FIG. 17, when one of the block tumbler elements is wrongly depressed, it extends into the corresponding hole in the check slide and blocks the check slide. In this case, the tumbler members have to be reset all by means of the reset button 30 and the correct number combination has to be put in again.

Figure 16:
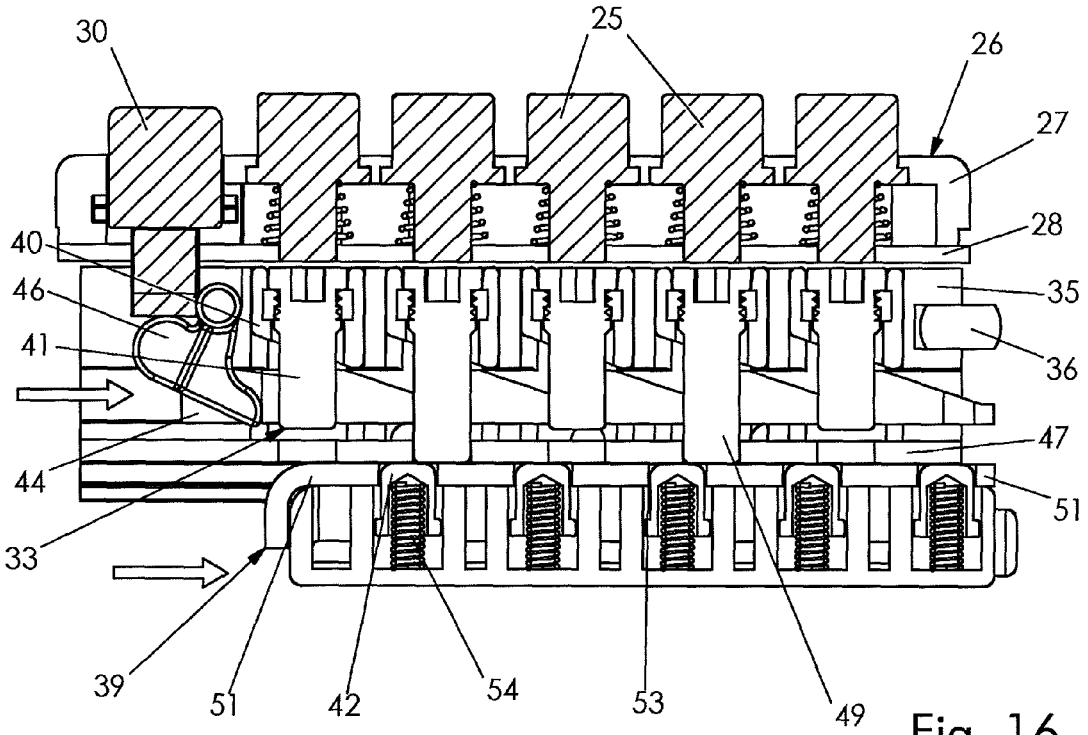
FIG. 16 illustrates the movement of the released check slide from its first to its second position upon retracting the latch bolt by means of the latch bolt actuating mechanism and the simultaneous resetting of the tumbler members to their normal positions by the reset slide.
Figure 23:
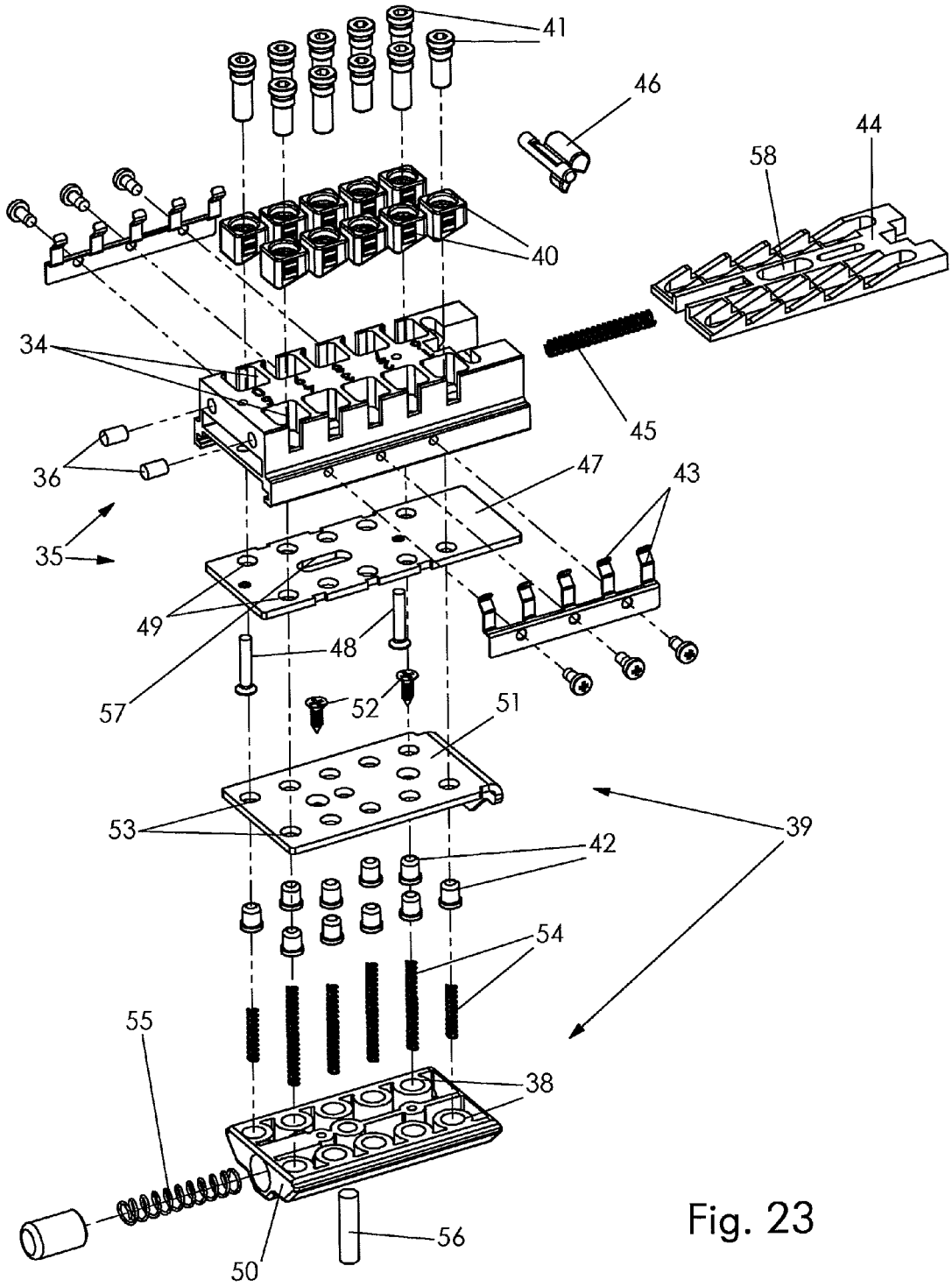

FIG. 16 illustrates the sliding movement of the released check slide 39 from its first normal position, against the bias of the spring 55, to its second position. It also illustrates that during this movement all of the tumbler members 33 are automatically reset by the reset slide 44, i.e. without having to operate the reset button 30. Once the door or gate has been opened and is closed again, it is thus automatically locked. The automatic reset of the tumbler members 33 is achieved by means of the peg 56 which is fixed, as shown in FIG. 23, in a hole in the check slide 39. This peg 56 extends through a slit 57 in the frame component 35 (more particularly in the bottom plate 47 thereof) and through a slit 58 in the reset slide 44. Seen in FIG. 23, in the normal rest position of the check slide 39, the peg 56 extends in the left end of the slit 57 and in the right end of the slit 58. The tumbler members 33 can thus be reset by moving the check slide 39, and at the same time the reset slide 44, to the right (when the check slide has been released by means of the right number combination) or by moving only the reset slide 44, by means of the reset button 30, to the right (which is possible even when a wrong number combination has been used so that the check slide is blocked).

In order to enable to unlock the locking mechanism either with the pushbuttons on the front side of the lock or with the pushbuttons on the back side of the lock, the lock according to the invention comprises a selector 59, illustrated in FIGS. 5 to 12 and 21, which can be blocked or released by the first and second check slides 39 and which couples these check slides to the lock bolt mechanism, i.e. either to the bolt itself or to the lock bolt actuating mechanism. In the preferred embodiment illustrated in the figures, the selector 59 is coupled to the latch bolt actuating mechanism so that when the tumbler members are automatically reset after having opened the door or gate (and the check slide is thus blocked again), the door or gate can still simply be closed without having to put in the right number combination again.

Figure 21:
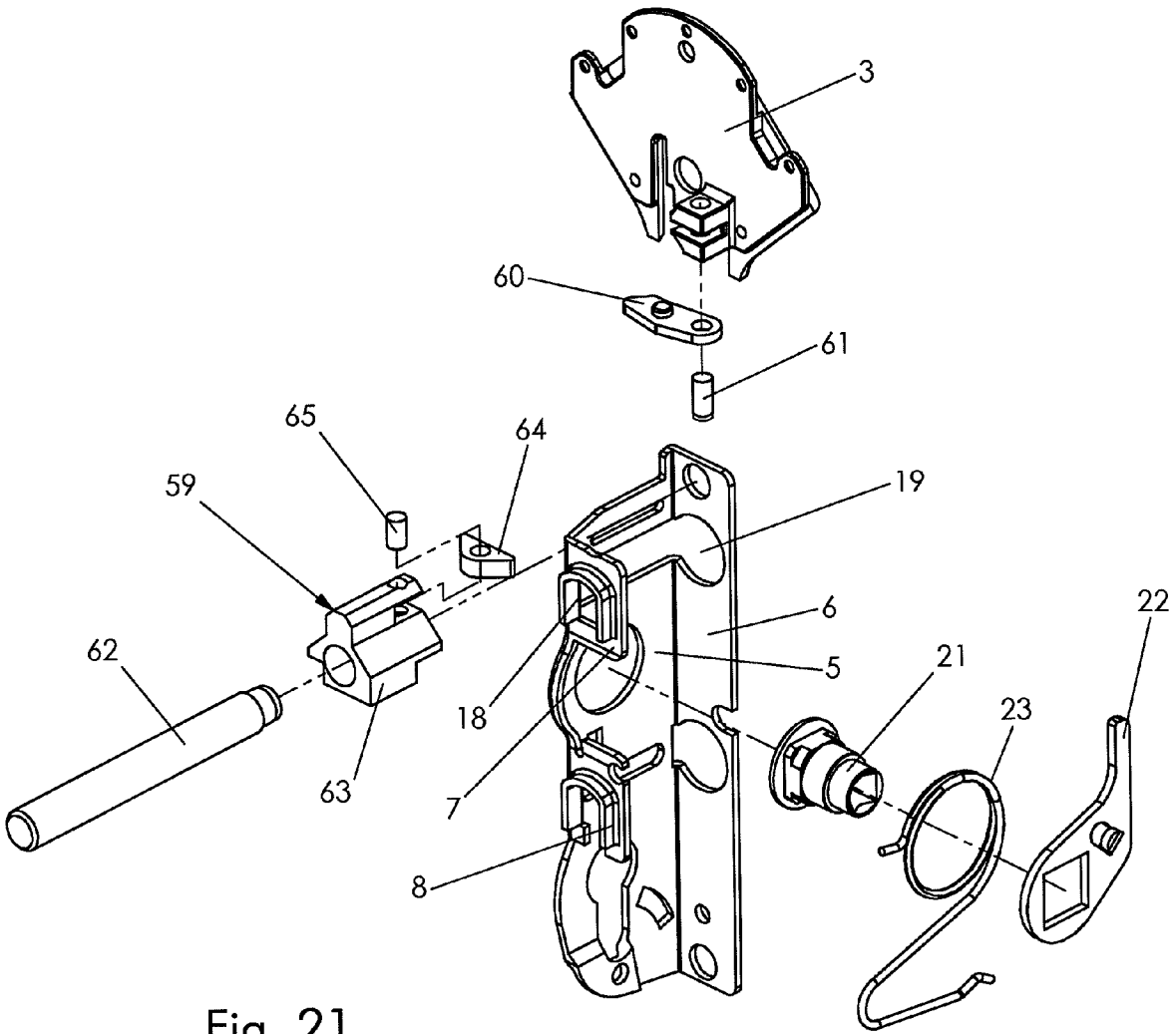
FIGS. 21 to 23 illustrate exploded views of the main components illustrated in FIG. 20, including the component with the frame elements onto which the selector is slidably mounted, the keyboard with the pushbuttons and the component including the tumbler members, the reset slide and the check slide.

In the embodiment illustrated in the figures, the latch bolt lever 22 does not only act upon the projection 24 on the latch bolt 17 but extends further to engage a lever 60 which is pivoted about a pivot 61 fixed to the frame (see FIG. 21). The latch bolt lever 22 engages the lever 60 at a first distance from the pivot 61. The lever 60 itself engages the selector 59 at a second distance from the pivot 61 which is smaller than the first distance. In this way, the displacement of the selector 59 is reduced so that a smaller force has to be exerted onto the latch bolt lever 22 and so that especially the locking mechanism can be made more compact as will appear hereafter (the holes in the check slides 39 can be made closer to one another due to the smaller displacement of the check slides). It is clear that, instead of using the latch bolt lever 22 to engage the lever 60 or the selector 59, an additional lever can be provided therefor on the latch bolt actuating mechanism.

The selector 59 is slidably mounted on the frame, more particularly onto a shaft 62 having one end fixed to the cover box 2 and the other end fixed to the upstanding edge 6 of the base plate 5. The selector 59 comprises a main body part 63 and a switch element 64 pivotally mounted about a pivot 65 on the main body part 63 of the selector 59. In the figures the switch element 64 is a triangular element, one side of which is in engagement with the first check slide 39 and another side of which is in engagement with the second check slide 39.

In this way, when both check slides are blocked, the selector 59 cannot move along the shaft 62 and blocks the lever 60 and thereby also the latch bolt lever 22 so that the latch bolt actuating mechanism is locked. When one of the check slides 39 is however released whilst the other remains blocked (unlocking of the lock from one side of the lock), the switch element 64 switches automatically to the check slide which is released. In fact, the sides of the switch element form cam surfaces which engage cams formed by the (edges of the) check slides so that the switch element automatically pivots towards the released check slide when the selector is pushed against the check slides. It is also possible to round the edges of check slides so that these rounded edges form cam surfaces whilst the switch element forms cams sliding along these cam surfaces. The triangular switch element 64 illustrated in the figures is in fact a lever having a first lever arm situated on one side of the pivot 65 and engaging the first check slide and a second lever arm situated on the opposite side of the pivot 65 and engaging the second check slide 39.

An alternative embodiment of the selector 59 and of the lever 60 is illustrated in FIGS. 26 to 31. The selector 59 comprises a switch element 64 which is the main body part of the selector 59 and which cannot only slide over the shaft 62 but which can also pivot about this shaft 62. The selector 59 has a lever arm 66 which engages a bevelled edge 67 of the check slides 39 so that it automatically pivots towards the check slide 39 which is released. The lever 60 is now replaced by a lever 60 which pivots about a horizontal instead of about a vertical pivot 61 and has a curved side engaging the selector so as to reduce the frictional forces.

Figure 4:
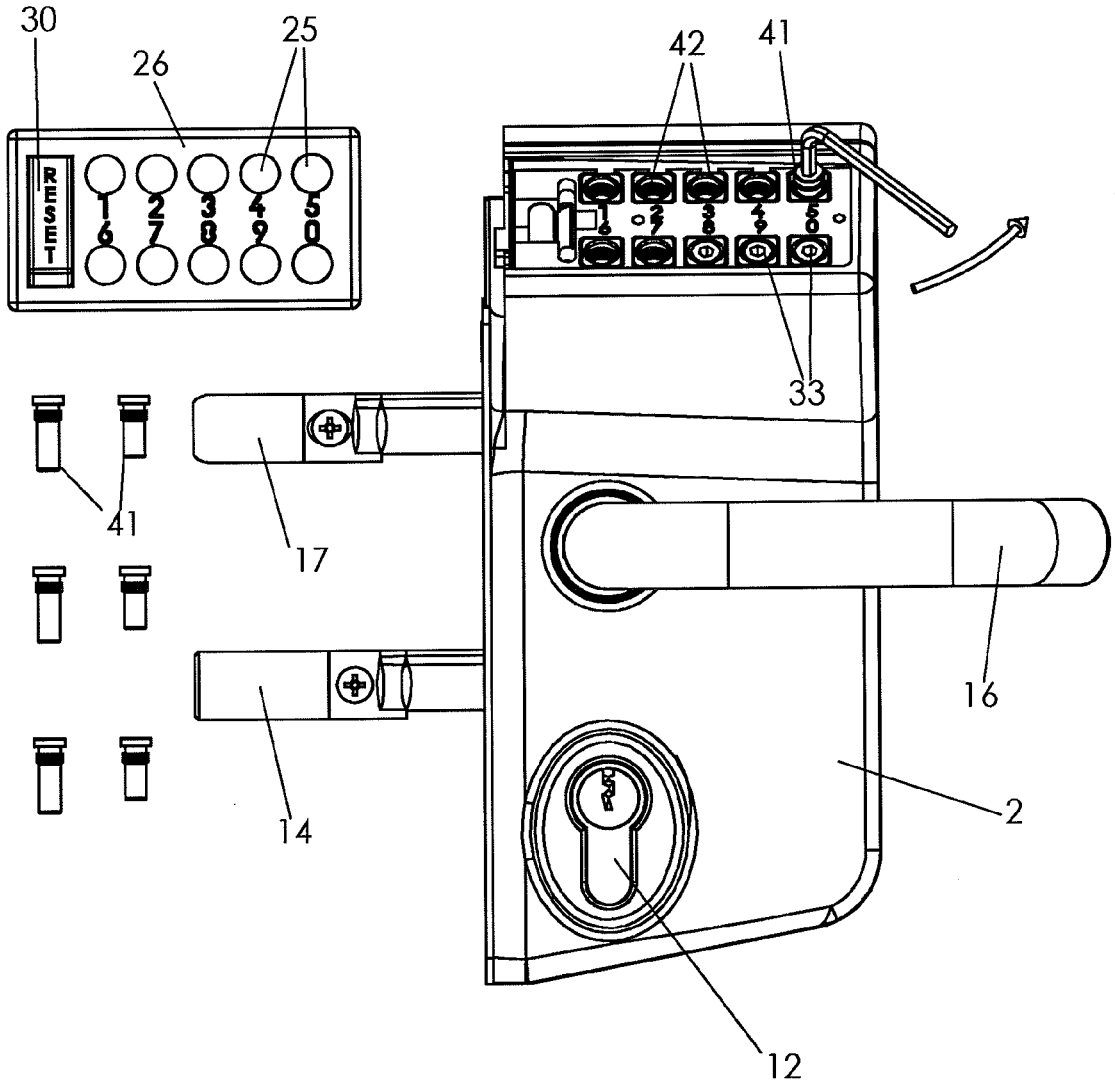
FIG. 4 shows a front elevational view of the lock illustrated in the previous figures but having the keyboard and a number of block screws and of code screws removed.

In another embodiment, which has not been illustrated in the drawings, the switch element could be modified so that it would no longer automatically switch to the released check slide but so that the person who wants to unlock the lock has to push in for example a pushbutton which moves the selector to the check slide which can be released from the side of the lock where the person is present. Since such an embodiment is more complex and less user friendly, it is less preferred. A first advantage of the lock illustrated in the drawings is that the number combination may be different on both sides of the lock and can easily be changed, as illustrated in FIGS. 2 to 4, by simply removing the respective keyboard 26 and by replacing the "shorter" code tumbler elements by "longer" block tumbler elements or vice versa.

Figure 24:
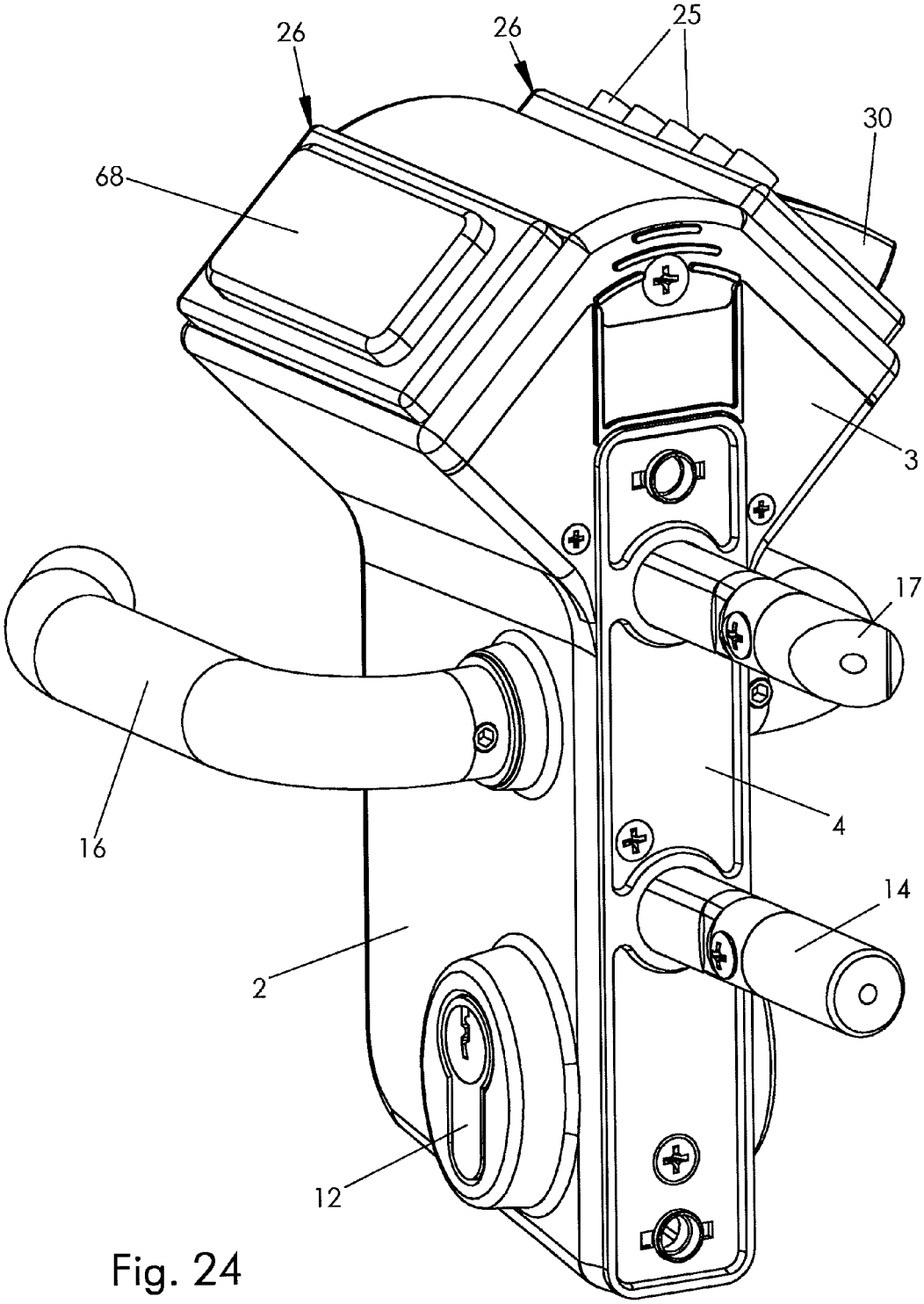
FIG. 24 shows a perspective view of the lock illustrated in the previous figures having one keyboard with pushbuttons replaced by a keyboard with one single, large pushbutton.
Figure 25:
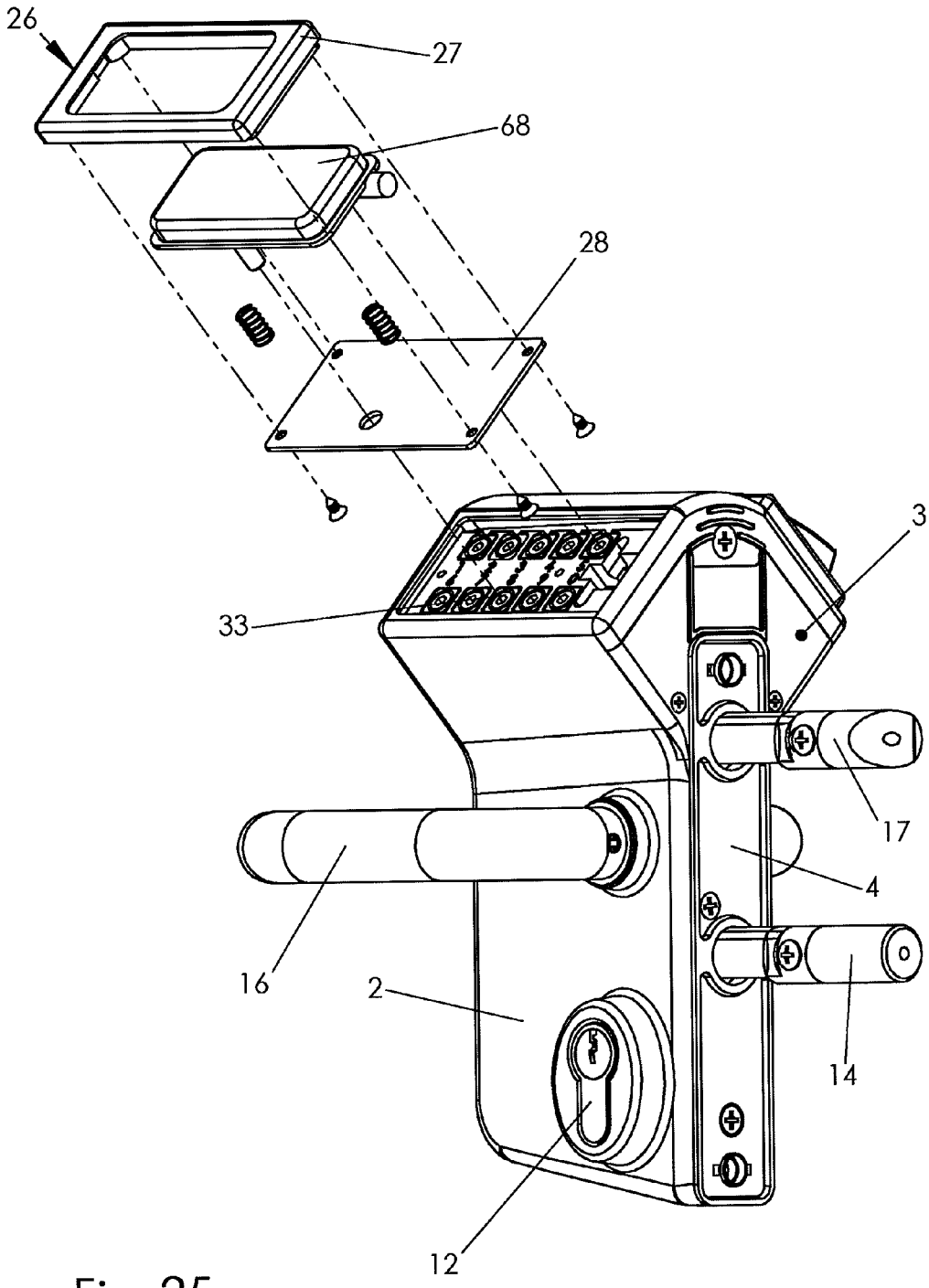
FIG. 25 shows the lock of FIG. 24 with the keyboard removed and illustrated in an exploded view.

A further advantage is that one of the keyboards 26 may even be replaced by a keyboard with only one large pushbutton 68 so that the lock can very easily be unlocked from one side of the door or gate. Such a possibility is illustrated in FIGS. 24 and 25 and is very suitable if the door or gate allows no or difficult access to the other side of the lock. The keyboard with the large pushbutton can be sold, as a set, with the lock according to the invention. An advantage of the two same locking mechanisms on both sides of the lock is that the keyboard with the large pushbutton can be used on either side of the lock so that a same lock can be used both for left and for right turning doors.

The embodiment illustrated in FIGS. 32 to 37 incorporates a security slide 69 to protect the lock code. In the previously illustrated embodiments there is a danger that, by depressing the lock handle 16 before the pushbuttons 25, it may be possible to slightly displace the check slide 39, so that it opposes a greater resistance to depressing the "long" code bodies 40 than the "short" code bodies 40 or vice versa, depending on the shape of the lowermost extremities of the "long" code bodies 40. This would enable an intruder to pick the lock code. In order to avoid this, the security slide 69 is also linked to the lock handle 16 through the follower 21, latch bolt lever 22, lever 60 and selector 59, so that, when the lock handle 16 is depressed, the security slide 69 will be displaced from a first position, illustrated in FIGS. 32, 34 and 35 to a second position, illustrated in FIGS. 33, 36 and 37. To enable this relatively small displacement, a small distance is provided between the selector 59 and the check slides 39. The security slide 69 comprises a plate-like portion 70 which is interposed between said first series of pushbuttons 25 and said first series of tumbler members 33, and which comprises a first series of holes 71 corresponding to the first series of pushbuttons 25. In the first position illustrated in FIGS. 32, 34 and 35, the holes 71 are aligned between the pushbuttons 25 and the tumbler members 33, allowing said pushbuttons 25 to engage said tumbler members 33 when depressed. When however the security slide 69 is displaced to the second position illustrated in FIGS. 33, 36 and 37, the holes 71 are no longer aligned, and the plate 70 locks the pushbuttons 25 in their normal position, out of engagement with the tumbler members 33. The pushbuttons 25 can therefore only be depressed when the lock handle 16 is released.

In the illustrated embodiment, the security slide 69 is normally held in the first position by the selector 59, more particularly under the bias of a relatively strong additional coil spring 73, and biased towards the second position by a less strong spiral spring 72. In this way, if the selector 59 moves slightly due to actuation of the lock handle 16 as illustrated in FIG. 36, the additional coil spring 73 is compressed and the coil spring 72 urges the security slide 69 to its second position. Alternatives to this arrangement, such as using a leaf spring instead of spiral spring 72 or a different coupling with the lock bolt actuating mechanism are within the reach of the skilled person.

Although in the FIGS. 32 to 37 only one security slide 69 is visible, a further security slide 69 is preferably provided so that there are two security slides 69, one for each side of the lock. The two security slides 69 are preferably connected to one another so that the two series of pushbuttons are simultaneously blocked when operating the lock bolt actuating mechanism. In the above described embodiment wherein one of the keyboards 26 is replaced by a keyboard with only one large pushbutton 68, as in FIGS. 24 and 25, the second security slide 69 would of course be unnecessary. Also a combination lock containing only one series of pushbuttons, would contain only one security slide 69.

The invention claimed is:

1. A pushbutton combination lock comprising:

a frame (1);

a lock bolt mechanism comprising:

a lock bolt (17) movably mounted on the frame (1) between a locking and an unlocking position; and a lock bolt actuating mechanism (21, 22) arranged to move the lock bolt (17) between the locking and unlocking positions and operable from a first and a second side of the lock; and a locking mechanism for locking the lock bolt mechanism to prevent the lock bolt (17) from being moved by the lock bolt actuating mechanism (21, 22) to the unlocking position, which locking mechanism comprises:

a first series of pushbuttons (25) on the first side of the lock and a second series of pushbuttons (25) on the second side of the lock; and a first series of tumbler members (33) movable between normal and depressed stable positions by means of respective pushbuttons (25) of said first pushbutton series, characterised in that the locking mechanism further comprises:

a first check slide (39) movably mounted on the frame (1) between a first and a second position and co-operating with the first series of tumbler members (33) to be blocked, in its first position, or to be released thereby so as to be movable to its second position;

a second series of tumbler members (33) movable between normal and depressed stable positions by means of respective pushbuttons (25) of said second pushbutton series;

a second check slide (39) movably mounted on the frame (1) between a first and a second position and co-operating with the second series of tumbler members (33) to be blocked, in its first position, or to be released thereby so as to be movable to its second position; and a selector (59) which is movably mounted on the frame (1) and which is blocked or released by the first and second check slides (39), the selector (59) coupling the first and/or the second check slides (39) to the lock bolt mechanism (17, 21, 22) so that, at least when the first and the second check slides (39) are blocked, the selector (59) is blocked and is locking the lock bolt mechanism, and the selector (59) being arranged to be released by either the first or the second check slide (39) so that the lock bolt mechanism can be unlocked by releasing the first or respectively the second check slide (39).

2. A lock according to claim 1, characterised in that the selector (59) comprises a switch element (64)

which engages both the first and the second check slides (39) to lock the lock bolt mechanism when the first and second check slides (39) are blocked, which switches to the first check slide (39) so that the selector (59) is released and the lock bolt mechanism unlocked thereby when the first check slide (39) is released whilst the second check slide (39) remains blocked and which switches to the second check slide (39) so that the selector is released and the lock bolt mechanism unlocked thereby when the second check slide (39) is released and the first check slide (39) remains blocked.

3. A lock according to claim 2, characterised in that the switch element (64) is pivotally mounted about a pivot (65) and the switch element (64) and the first and the second check slides (39) comprise mutually co-operating cams and cam surfaces to pivot the switch element (64) to switch to the first or to the second check slide (39) upon operation of the lock bolt actuating mechanism when the first or respectively the second check slide (39) is released and the other check slide (39) is blocked.

4. A lock according to claim 2, characterised in that the switch element (64) comprises a switch lever pivotally mounted about a pivot (65) and having a first lever arm situated on one side of the pivot (65) and engaging the first check slide (39) and a second lever arm situated on an opposite side of the pivot and engaging the second check slide (39).

5. A lock according to any claim 1, characterised in that it further comprises a security mechanism including at least a first security slide (69) which is interposed between said first series of pushbuttons (25) and said first series of tumbler members (33) and which is movable between a first position, wherein it allows the tumbler members (33) of the first series to be moved by the respective pushbuttons (25) of the first pushbutton series from their normal to their depressed stable positions, and a second position wherein it prevents the tumbler members (33) of the first series to be moved by the respective pushbuttons (25) of the first pushbutton series from their normal to their depressed stable positions, the security slide (69) being coupled to the lock bolt mechanism (17, 21, 22) so as to be moved to said second position if said lock bolt mechanism (17, 21, 22) is actuated to move the lock bolt (17) towards its unlocking position.

6. A lock according to claim 5, characterised in that said security mechanism comprises a second security slide (69) which is interposed between said second series of pushbuttons (25) and said second series of tumbler members (33) and which is movable between a first position, wherein it allows the tumbler members (33) of the second series to by moved by the respective pushbuttons (25) of the second pushbutton series from their normal to their depressed stable positions, and a second position wherein it prevents the tumbler members (33) of the second series to be moved by the respective pushbuttons (25) of the second pushbutton series from their normal to their depressed stable positions, the second security slide (69) being coupled to the lock bolt mechanism (17, 21, 22) so as to be moved to said second position if said lock bolt mechanism (17, 21, 22) is actuated to move the lock bolt (17) towards its unlocking position and the second security slide (69) being preferably connected to said first security slide (69).

7. A lock according to claim 1, characterised in that the lock bolt is a latch bolt (17) which is biased by means of a latch bolt spring (20) out of the frame (1) of the lock and the selector (59) couples the first and/or the second check slide (39) to the lock bolt actuating mechanism (21, 22) so that the latch bolt (17) can be pushed in against the spring bias even when the first and the second check slides (39) are both blocked.

8. A lock according to claim 7, characterised in that it further comprises a dead bolt (14) and a key operated dead bolt actuating mechanism (12).

9. A lock according to claim 1, characterised in that the locking mechanism further comprises a first reset slide (44) for resetting the tumbler members (33) of the first series all to their normal positions and a second reset slide (44) for resetting the tumbler members (33) of the second series all to their normal positions, both the first and the second check slides (39) being blocked when the tumbler members (33) of the first and of the second series are in their normal positions.

10. A lock according to claim 9, characterised in that it comprises a first coupler element (56) interposed between the first check slide (39) and the first reset slide (44) and a second coupler element (56) interposed between the second check slide (39) and the second reset slide (44) to actuate the first and second reset slide (44) upon actuation of the first and respectively the second check slide (39).

11. A lock according to claim 1, characterised in that the second series of pushbuttons (25) is replaced by one single pushbutton (68) acting on a number of the tumbler members (33) of the second series to move them to their depressed position when the push button (68) is being pushed in, the tumbler members (33) of the second series being selected in such a manner that only the tumbler member or members (33) onto which the single pushbutton (68) acts need to be depressed to release the second check slide (39).

12. A lock according to claim 1, characterised in that said lock bolt actuating mechanism (21, 22) comprises a follower (21) which is pivotally mounted on the frame (1) and arranged to receive a handle shaft, the follower (21) being provided with a lever (22) which is coupled to the selector (59) so as to block the follower (21) when the selector (59) is blocked and so as to release the follower (21) so that the lock bolt (17) can be moved to its unlocking position by means of the follower (21) when the selector (59) is released.

13. A lock according to claim 12, characterised in that the lever (22) on the follower (21) is coupled through the intermediary of a further lever (60), which is pivotally mounted about a pivot (61) on the frame (1), to the selector (59), the lever (22) on the follower (21) engaging the further lever (60) on a first distance from said pivot (61) and the further lever (60) engaging the selector (59) on a second distance from said pivot (61) which is smaller than said first distance.

14. A lock according to claim 1, characterised in that the tumbler members (33) each comprise a first (40, 41) and a second tumbler element (42), in that the frame (1) is provided with holes (34) arranged to receive the first tumbler elements (40, 41) and the first and the second check slides (39) with further holes (38) arranged to receive the second tumbler elements (42), and in that, when the first and second check slides (39) are in their first position, said further holes (38) are situated opposite said holes (34), the first tumbler elements (40, 41) are axially movable by means of the respective pushbutton (25) in said holes (34) between a first stable position, wherein the tumbler member (33) is in its normal position, and a second stable position, wherein the tumbler member (33) is in its depressed position, and the second tumbler elements (42) are axially movable in said further holes (38) and are biased by means of springs (54) against the corresponding first tumbler element (40, 41), the first tumbler elements (40, 41) of the first series and the first tumbler elements (40, 41) of the second series of tumbler members (33) each comprise one or more code tumbler elements (40, 41) having such a length that when they are in said first position, the corresponding second tumbler elements (42), which engage the code tumbler elements, project into one of said holes (34) to block the first and respectively the second check slide (39), and when the code tumbler elements are in said second position, they push the corresponding second tumbler elements (42) into said further holes (38) without projecting themselves therein, any remaining first tumbler elements (40, 41) being block tumbler elements having such a length that, when they are in said first position, they push the corresponding second tumbler elements (42) which engage the block tumbler elements into said further holes (38) without projecting themselves into these holes, and when the block tumbler elements (40, 41) are in said second position, they project into said further holes (38) thereby blocking the respective check slide (39).

15. A lock according to claim 14, characterised in that the first tumbler elements (40, 41) each comprise a base body (40) and a code body (41), the base bodies (40) having an axial through hole and are movable mounted in one of said holes (34) and the code bodies (41) being releasably fixed, to the respective base body (40) to extend through said through hole and to engage the corresponding second tumbler element (42).

16. A pushbutton combination lock comprising:

a frame (1);

a lock bolt mechanism comprising:

a lock bolt (17) movably mounted on the frame (1) between a locking and an unlocking position; and a lock bolt actuating mechanism (21, 22) arranged to move the lock bolt (17) between the locking and unlocking positions; and a locking mechanism for locking the lock bolt mechanism 17, 21, 22) to prevent the lock bolt (17) from being moved by the lock bolt actuating mechanism (21, 22) to the unlocking position, which locking mechanism comprises:

at least one series of pushbuttons (25);

at least one series of tumbler members (33) movable between normal and depressed stable positions by means of respective pushbuttons (25) of said pushbutton series; and at least one check slide (39) which is movably mounted on the frame (1) between a first and a second position, which co-operates with the series of tumbler members (33) to be blocked, in said first position of the check slide (39), or to be released thereby so as to be movable to said second position, and which is coupled to the lock bolt mechanism (17, 21, 22) to lock or unlock said lock bolt mechanism, characterised in that the tumbler members (33) each comprise a first (40, 41) and a second tumbler element (42), in that the frame (1) is provided with holes (34) arranged to receive the first tumbler elements (40, 41) and the check slide (39) with further holes (38) arranged to receive the second tumbler elements (42), and in that, when the check slide (39) is in its first position, said further holes (38) are situated opposite said holes (34), the first tumbler elements (40, 41) are axially movable by means of the respective pushbutton (25) in said holes (34) between a first stable position, wherein the tumbler member (33) is in its normal position, and a second stable position, wherein the tumbler member (33) is in its depressed position, and the second tumbler elements (42) are axially movable in said further holes (38) and are biased by means of springs (54) against the corresponding first tumbler element (40, 41), the first tumbler elements (40, 41) comprise one or more code tumbler elements having such a length that when they are in said first stable position, the corresponding second tumbler elements (42), which engage the code tumbler elements, project into one of said holes (34) to block the check slide (39), and when the code tumbler elements are in said second position, they push the corresponding second tumbler elements (42) into said further holes (38) without projecting themselves therein, any remaining first tumbler elements (40, 41) being block tumbler elements having such a length that, when they are in said first stable position, they push the corresponding second tumbler elements (42) which engage the block tumbler elements into said further holes (38) without projecting themselves into these holes, and when the block tumbler elements are in said second stable position, they project into said further holes (38) thereby blocking the check slide (39), the first tumbler elements (40, 41) each comprising a base body (40) and a code body (41), the base bodies (40) having an axial through hole and are movably mounted in one of said holes (34) and the code bodies (41) being removably fixed to the respective base body (40) to extend through said through hole and to engage the corresponding second tumbler element (42) in the first position of the check slide (39).

17. A lock according to claim 16, characterised in that the code bodies (41) are screwed to the base bodies (40).

18. A lock according to claim 17, characterised in that the pushbuttons (25) are contained in a keyboard (26) which can be removed from the frame (1) to provide access to the tumbler elements (33) to enable to interchange the code bodies (41).

19. A lock according to claim 15 or 16, wherein the locking mechanism comprises spring detents (43) for holding the tumbler members (33) in their normal and depressed stable positions, which spring detents (43) act upon said base bodies (40).

20. A lock according to claim 15 or 16, wherein the locking mechanism comprises a reset slide (44) for resetting the tumbler members (33) to their normal positions, the check slide (39) being blocked when the tumbler members (33) are in their normal positions and the reset slide (44) acting upon said base bodies (40) to reset the tumbler members (33) to their normal positions.

21. A lock according to claim 15 or 16, wherein it further comprises a security mechanism including a security slide (69) which is interposed between said series of pushbuttons (25) and said series of tumbler members (33) and which is movable between a first position, wherein it allows the tumbler members (33) to by moved by the respective pushbuttons (25) from their normal to their depressed stable positions, and a second position wherein it prevents the tumbler members (33) to be moved by the respective pushbuttons (25) from their normal to their depressed stable positions, the security slide (69) being coupled to the lock bolt mechanism (17, 21, 22) so as to be moved to said second position if said lock bolt mechanism (17, 21, 22) is actuated to move the lock bolt (17) towards its unlocking position.

22. A pushbutton combination lock comprising:

a frame (1);

a lock bolt mechanism comprising:

a lock bolt (17) movably mounted on the frame (1) between a locking and an unlocking position; and a lock bolt actuating mechanism (21, 22) arranged to move the lock bolt (17) between the locking and unlocking positions; and a locking mechanism for locking the lock bolt mechanism 17, 21, 22) to prevent the lock bolt (17) from being moved by the lock bolt actuating mechanism (21, 22) to the unlocking position, which locking mechanism comprises:

at least one series of pushbuttons (25);

at least one series of tumbler members (33) movable between normal and depressed stable positions by means of respective pushbuttons (25) of said pushbutton series; and at least one check slide (39) which is movably mounted on the frame (1) between a first and a second position, which co-operates with the series of tumbler members (33) to be blocked, in said first position of the check slide (39), or to be released thereby so as to be movable to said second position, and which is coupled to the lock bolt mechanism (17, 21, 22) to lock or unlock said lock bolt mechanism, characterised in that it further comprises a security mechanism including a security slide (69) which is interposed between said series of pushbuttons (25) and said series of tumbler members (33) and which is movable between a first position, wherein it allows the tumbler members (33) to by moved by the respective pushbuttons (25) from their normal to their depressed stable positions, and a second position wherein it prevents the tumbler members (33) to be moved by the respective pushbuttons (25) from their normal to their depressed stable positions, the security slide (69) being coupled to the lock bolt mechanism (17, 21, 22) so as to be moved to said second position if said lock bolt mechanism (17, 21, 22) is actuated to move the lock bolt (17) towards its unlocking position.

* * * * *